US005858299A

United States Patent [19]

Fernholz et al.

[11] Patent Number: 5,858,299

[45] Date of Patent: Jan. 12, 1999

[54] PROCESS FOR CONSOLIDATING PARTICULATE SOLIDS

[75] Inventors: Peter J. Fernholz, Burnsville, Minn.; Sandra Witt, Langenfeld, Germany; Hans-Peter Koehler, Duesseldorf, Germany; Wolfgang Preibsch, Merzench, Germany; Horst Pruehs, Duesseldorf, Germany; Karl-Heinz Rogmann, Ratingen, Germany

[73] Assignee: Ecolab, Inc., St. Paul, Minn.

[21] Appl. No.: 796,877

[22] Filed: Feb. 7, 1997

Related U.S. Application Data

[63] Continuation of Ser. No. 523,852, Sep. 5, 1995, abandoned, which is a continuation of Ser. No. 202,629, Feb. 18, 1994, abandoned, which is a continuation-in-part of Ser. No. 182,869, Jan. 14, 1994, which is a continuation-in-part of Ser. No. 57,728, May 5, 1993, abandoned.

[51] Int. Cl.[6] ..... B27N 5/00

[52] U.S. Cl. ..... 264/414; 264/426; 264/434; 264/460; 264/489; 264/122; 264/125; 510/298; 510/392; 510/439; 510/446; 510/530

[58] Field of Search ..... 264/414, 415, 264/426, 434, 460, 489, 491, 109, 122, 125; 510/298, 392, 439, 446, 530

[56] References Cited

U.S. PATENT DOCUMENTS

| | | | |
|---|---|---|---|
| 32,763 | 10/1861 | Fernholtz et al. . | |
| 32,818 | 1/1861 | Fernholtz, et al. . | |
| 3,366,570 | 1/1968 | Slob | 252/174 |
| 3,649,545 | 3/1972 | Susuki et al. | 252/174 |
| 3,849,327 | 11/1974 | DeSalvo et al. | 252/109 |
| 4,087,369 | 5/1978 | Wevers | 264/4 |
| 4,118,333 | 10/1978 | Dugan et al. . | |
| 4,451,386 | 5/1984 | Joshi | 264/109 |
| 4,587,031 | 5/1986 | Kruse et al. . | |
| 4,690,770 | 9/1987 | Jeschke et al. . | |
| 4,729,845 | 3/1988 | Altenschoepfer et al. . | |
| 4,806,327 | 2/1989 | Rieck et al. | 423/332 |
| 4,885,108 | 12/1989 | Richter et al. . | |
| 4,897,212 | 1/1990 | Krause et al. . | |
| 4,968,726 | 11/1990 | Thorsrup | 523/137 |
| 5,108,646 | 4/1992 | Beerse et al. | 252/174 |
| 5,232,622 | 8/1993 | Jones et al. | 252/135 |

FOREIGN PATENT DOCUMENTS

| | | |
|---|---|---|
| 1004876 | 2/1993 | Belgium . |
| 0224129 | 6/1987 | European Pat. Off. . |
| 2327956 | 12/1974 | Germany . |
| 3126884 | 1/1983 | Germany . |
| 59-141342 | 8/1984 | Japan . |
| 63-050800 | 3/1988 | Japan . |
| 2203752 | 10/1988 | United Kingdom . |
| 9209676 | 6/1992 | WIPO . |

*Primary Examiner*—Jan H. Silbaugh
*Assistant Examiner*—Kenneth M. Jones
*Attorney, Agent, or Firm*—Ernest G. Szoke; Wayne C. Jaeschke; Real J. Grandmaison

[57] ABSTRACT

A bed of particulate solids including some hydrated materials can be converted by controlled irradiation with subinfrared electromagnetic radiation into a unitary porous solid that is mechanically strong enough for easy handling. When the particulate solids include typical acid to alkaline cleaner materials, a block or tablet especially suitable for automatic cleaning machinery, with a very fast dissolution rate in water, can readily be obtained.

21 Claims, No Drawings

PROCESS FOR CONSOLIDATING PARTICULATE SOLIDS

This application is a continuation of application Ser. No. 08/523,852 now abandoned filed on Sep. 5, 1995 which is a continuation of Ser. No. 08/202,629 now abandoned filed on Feb. 18, 1994 which is a continuation-in-part of copending application Ser. No. 08/182,869 filed on Jan. 14, 1994 and is also a continuation-in-part of application Ser. No. 08/057,728 now abandoned filed on May 5, 1993.

BACKGROUND OF THE INVENTION

1. Field of the Invention

The invention relates to a process for consolidating beds of particulate solids that include some water into unitary porous solids. The invention also relates to various useful cleaning products, especially to textile, dishwashing, and surface care cleaning products in porous solid form, which can be made by the process. Still another aspect of the invention relates to using the novel solid detergents, cleaners, soaps and surface care products.

A product according to this invention is a "macrosolid", i.e., it is a unitary solid three dimensional object that is (i) capable, at a minimum, of retaining a definite shape and size under the influence of the normal ambient gravitational field at the surface of the earth and of being moved as a unit by forces exerted at only one end or edge thereof and (ii) sufficiently large to include within itself at least one hypothetical cube having a length of 2.5 millimeters (hereinafter often abbreviated "mm") on each edge. Preferably, with increasing preference in the order given, a macrosolid product according to the invention is sufficiently large to include within a single product a hypothetical cube having a length of 5, 6.5, 8.2, 10.0, 12.1, or 13.0 mm on each edge. A macrosolid thus contrasts with a conventional granular or powdered solid material, in which each unitary particle is normally no more than 2.2 mm in at least one of its three principal geometric dimensions. (Granular or powdered solid cleaners are often preferred for domestic use, where the amount of cleaning power required often is highly variable from one use of the cleaner to the next. However, granular or powdered cleaners require the performance of a separate volume or mass measuring step in order to give reproducible results and efficient use of the cleaner. Therefore, under industrial or other conditions where the amount of cleaning power needed from one use of a cleaner to the next is fairly constant, and/or the value of time saved is more economically important than the possible waste of small amounts of cleaner, macrosolid cleaners are generally preferred, because a worker can quickly select and use some small integral number, usually one, of the macrosolid cleaners for each instance of use, without the need for any more time-consuming measurement step.)

The units of the macrosolid cleaner according to this invention are commonly called "tablets" or "blocks", and these terms are used herein for convenience in description but are not to be understood in and of themselves to imply anything about the content, strength, or application of the particular formulation. Smaller macrosolids on the order of 10 to 50 grams in mass are generally referred to as "tablets" because such relatively small macrosolids often are cylinders with a height substantially less than the diameter, while larger macrosolids with masses on the order of 100 grams (hereinafter often abbreviated "g") to several kilograms (hereinafter often abbreviated "kg") are generally referred to as "blocks". Unless explicitly further qualified, however, neither "tablet" or "block" should be understood herein as having any quantitative implications.

2. Discussion of Related Art

Acidic to strongly alkaline cleaners and detergents find wide application in the form of powders, granulates, tablets, pastes, and blocks. Tablets and blocks in the prior art have generally been made by pressing of powdered solids or of paste-like slurries of such solids, or by molding of molten constituents or of slurries of partially solid constituents in some liquid that readily fills a mold. Many prior art processes for the production of solid cleaning products or molded cleaners, for example, require heating and mixing of the raw materials and/or aqueous solutions in order to insure homogeneity in the final product. In addition, thickening, pouring, and cooling of the heated mixtures either alone or with the use of molds or forms may also be required.

Most conventional prior art techniques for the production of tablets or molded cleaners suffer from the disadvantage that they require the addition of certain additional auxiliaries, such as tabletting aids, which must be added to the cleaning-effective raw materials. These aids are required in order to stabilize the active ingredients to form a slurry or paste mixture for further processing such as melting, pouring or being pressed into the final desired product form. Such auxiliaries add no cleaning power or other desired properties to the final product, but yet are often required to enable raw materials to be conveniently pumped or otherwise conveyed within a process, or to facilitate heat transfer where raw materials exhibit different degrees of heat stability. The use of such auxiliaries may also contribute to delivery and dissolving problems. The use of tabletting aids also is disadvantageous because it increases both raw materials and manufacturing costs.

OBJECT OF THE INVENTION

The development of a process that did not involve increased pressures, or heating, pumping, pouring, cooling of melts, and the like, with the attendant required steps could potentially streamline the manufacturing process of solid detergents and cleaners. Moreover, a savings of raw materials could also be realized if the addition of components that are required solely for handling or heat stabilization purposes were no longer required. Newer methods have been sought to overcome these disadvantages. Currently, there is also a desire for higher performance products, which implies the use of lesser quantities of auxiliaries and therefore greater quantities of active components in smaller volumes. This gives rise to what is perceived as a "stronger" product. The result is the tendency towards more concentrated raw materials mixtures which, during the course of manufacture, may exist as fluids and/or molten streams, with attendant handling and processing concerns. It would therefore be advantageous to develop a process for the manufacture of detergent or cleaner products that demonstrated the required efficacy and featured ease and greater convenience in raw material handling and processing.

It is therefore an object of the present invention to provide a process for the formation of solid tablet or block cleaning products directly from powder or granular raw material mixtures.

It is also an object of the present invention to provide a process, for the formation of solid tablet or block cleaning products directly from powdered or granular raw material mixtures, which does not require the bulk melting of raw material mixtures, and which accommodates certain useful constituent materials that may be impractical to use in a melt process because of temperature sensitivity or related considerations.

It is a still further object of the present invention to provide an alternate process and associated formulations for the production of macrosolid detergents or cleaners in which the need for non-active ingredients such as ballast, fillers, tabletting aids, and the like is eliminated or at least reduced.

Still other objects of this invention will be apparent from the description below.

DESCRIPTION OF THE INVENTION

Other than in the operating examples, or where otherwise explicitly indicated, all numbers expressing quantities of ingredients or reaction conditions used herein are to be understood as modified in all instances by the term "about" in describing the broadest scope of the invention. Practice within the numerical limits given, however, is generally preferred.

Also, unless there is an explicit statement to the contrary, the description below of groups of chemical materials as suitable or preferred for a particular ingredient according to the invention implies that mixtures of two or more of the individual group members are equally as suitable or preferred as the individual members of the group used alone. Furthermore, the specification of chemical materials in ionic form should be understood as implying the presence of some counterions as necessary for electrical neutrality of the total composition. In general, such counter ions should first be selected to the extent possible from the ionic materials specified as part of the invention; any remaining counterions needed may generally be selected freely, except for avoiding any counterions that are detrimental to the objects of the invention. Also, unless otherwise specified, figures expressed in terms of "percent" or "%" are to be understood as percent by weight.

SUMMARY OF THE INVENTION

It has surprisingly been discovered that high frequency electromagnetic energy in the subinfrared range may be utilized for the rapid formation of macrosolids from a volume of more to less tightly packed powder or granular raw material(s), when at least part of these raw materials are hydrated, and that this process may be used to produce particularly useful acidic to strongly alkaline cleaners in macrosolid form. An important feature of the invention is that reusable molds or "receptacle molds" can be employed to enable the formation of tablets or block macrosolids with excellent reliability and reproducibility. An advantage of the technique is that it eliminates the need for forming intermediate bulk molten or fluid phases and also eliminates the alternative need for high pressure compression in order to generate the final macrosolid product form. A further advantage of the invention is that certain components, which heretofore could not practically be included in tablets produced by the prior art technique of forming tablets under pressure, may be incorporated directly into the macrosolids formed.

In this description, the term "cleaner" or "cleaning composition" includes any substance that can readily be used to clean a hard surface or a textile, and thus includes compositions otherwise known as detergents, cleaners, all-purpose cleaners, scouring cleaners, pre-soak, and pre-wash products, whether formulated for domestic, institutional, or industrial application or for manual or automatic laundry washing and dishwashing, ware-washing, surface washing, floor care, hard surface cleaning, or the like in any shape.

The term "hydrated" as used herein is to be understood as qualified implicitly, if not explicitly, to mean "hydrated at particular conditions of temperature, pressure, and relative humidity of the atmosphere to which exposed or with which in equilibrium", and if these conditions are not specified explicitly, they are to be understood as those of the ambient atmosphere in a space within which the temperature is maintained within the normal range for human comfort, i.e., 18°–30° C., and the relative humidity is between 5 and 95%, and further as implying that at least one of the following characterizations of the material is true: (i) The material is a solid including stoichiometrically well characterized water of hydration or (ii) the material is liquid and/or solid with a definite measurable mass and, if the temperature of the material is raised by a sufficient amount above the reference temperature at which the material is hydrated, and/or if the pressure and/or relative humidity of the gaseous atmosphere to which the material is exposed is lowered by a sufficient amount from that with reference to which the material is hydrated, the mass of water vapor in the atmosphere to which the material is exposed will be increased and the mass of the solid and/or liquid formerly hydrated material will decrease by an amount that is not more than 120%, or preferably, with increasing preference in the order given, not more than 115, 109, 106, 103 or 10 1%, of the amount by which the mass of the water vapor in the gaseous atmosphere to which the formerly hydrated material is exposed has increased. A combination of an initially anhydrous salt and liquid water which is temporarily absorbed by the salt, or even liquid water itself, can thus be a "hydrated" material as required for certain embodiments of this invention, but generally at least some solid hydrated material is preferred.

Normally, the above specified transfer of mass from the solid and/or liquid hydrated material to a water vapor containing gaseous phase, in order for the material to be useful in this invention, must occur to a measurable extent within 24 hours, or, with increasing preference in the order given, will occur within 8, 5, 2, 1, 0.5, 0.2, 0.09, or 0.005, hours after a change including at least one of the following conditions: The temperature is raised by 50° C.; the pressure is reduced by 100 millibars; and/or the relative humidity is reduced by 20%.

Microwaves, as described in the co-pending '728 application, have frequencies above 300 megahertz (hereinafter often abbreviated as "MHz"), and are generally regarded as having frequencies in the range of 300 to 300,000 MHz. Microwaves belong to the broader range of electromagnetic radiation herein referred to as "subinfrared electromagnetic radiation" or "SER", which have frequencies ranging from 3 to 300,000 MHz. The part of this portion of the electro-magnetic spectrum not occupied by microwaves is known as the "radio wave [or 'frequency'] range", and has frequencies in the range of 3 to 300 MHz. Microwaves are therefore very small wavelength subinfrared waves. According to the present invention, it is possible to use SER of either range, microwave or radio wave, to form the macrosolids further described below.

The term "microwave treatment [or 'irradiation']" or "treatment by [or 'irradiation with'] microwaves" as used herein refers to the exposure of a raw material or mixture thereof to electromagnetic energy of the microwave region. The term "SER treatment [or 'irradiation']"or "treatment by [or 'irradiation with'] SER" as used herein refers to the exposure of a raw material or mixture thereof to electromagnetic fields of frequencies from 3 to 300,000 MHz. The words "exposure" or "treatment" in connection with "SER" or "SER energy" are also to be understood to be generally synonymous within this context. Where it is necessary to further distinguish between lower frequency subinfrared electromagnetic energy (i.e., radio waves or "RW" energy, which is generally understood to mean about 3 to about 300 MHz), and higher frequency subinfrared electromagnetic energy (microwave range energy or "MW" energy, which is generally understood to mean about 300 to about 300,000 MHz), appropriate distinction will be made within the text.

Although the permitted radio frequencies vary from country to country, the most common frequencies for industrial, scientific and medical use ("ISM bands") for radio frequency include 13.56 and 27.12 MHz, while those for microwave frequency are 896 MHz and 2450 MHz.

For almost all non-conductive or dielectric chemical compounds that are stable at normal ambient temperatures of 18°–30° C., SER is nonionizing, but it can cause motion of some atoms in a material with respect to other atoms in the material by migration of ions, rotation of molecules with dipole moments, or polarization of molecules within the high frequency electromagnetic field. Exposure to SEFR does not cause permanent changes in chemical bonding in such material.

The terms "particles", "particulate matter", and "powder (s)" imply, unless explicitly stated to the contrary, that the material so described is in the solid phase. A "bed" of particulate matter means a collection of particles that, by virtue of mutual physical support among the particles, and, optionally, between some of the particles and at least part of the wall or walls of a container for the bed and/ or a solid insert within the bed, has a gross shape that does not change and a size that does not decrease by motion of the some of the constituent particles with respect to others of the constituent particles under the influence of the ambient gravitational force at the surface of the earth, in the absence of any localized vibration of the bed.

In addition to the solid particles in the bed, there may also be some liquid raw material in the bed, so long as the volume of liquid relative to the volume of solid in the bed is not so large as to excessively facilitate the motion of the solid particles in the bed with respect to one another, so as to cause the bed to fail to satisfy the conditions of having a gross shape and size unchanging under the influence of gravity as specified above.

The container in which a particle bed is present may be as simple as a flat sheet: on which a bed of particles rests, although ordinarily it will also have walls that offer some lateral support to the particle bed. The bottom and walls if any of the container may be of any material adequate to support the particle bed, i.e., not sufficiently porous that the particles can pass through the it under the influence of gravity and the pressure of overlying parts of the particle bed.

The material chosen for the container used according to the present invention may be any SER-compatible and SER-penetrable material and, in those processes where higher temperatures are achieved, preferably is a material that is capable of withstanding temperatures up to, e.g., 160° C. For processes starting from raw material beds containing NaOH in concentrations greater than 75%, polystyrene or polyethylene molds preferably are not used because of the danger of melting them. The material chosen for the container or mold should also be one which can be formed into and maintain the desired shape throughout repeated use, if such is desired. Suitable reusable container materials include glass, polyethylene, polypropylene, plastic, ceramics, or composites thereof, or any other SER-compatible material at the particular temperatures achieved, depending upon formulation of the starting raw materials. In those instances where the raw material mixture contains corrosive components, it is preferable to use a container made of material resistant to the corrosive effect of the contents. Plastic films, including water soluble films, may be effectively used as one time containers, which can be sealed after formation of the macrosolid product within them and serve as a shipping and dispensing container for the product.

The "bulk volume" of a bed of particulate matter or of a porous solid means the volume of the smallest pore- and interstitial space-free solid that could be formed by filling all the pores and interstitial spaces of the bed or porous solid, and the "pore volume" of a particle bed or porous solid means the total volume required to fill all the pores and interstitial spaces of the bed or porous solid to form such a smallest pore- and interstitial space-free solid. The "density" of a bed of particulate matter or of a porous solid means the ratio of the mass of the total of solid and liquid phases contained within the bed or porous solid to the bulk volume of the bed or porous solid.

In one major embodiment, a process according to this invention comprises steps, of:

(A) providing a container with walls penetrable by SER and having within the container a bed of particles of raw material, at least part of said raw material being a hydrated material; and (B) irradiating the bed of particles provided in step (A) for a sufficient time with SER of sufficient energy to cause the temperature of at least part of said raw material to rise, and subsequently discontinuing the irradiation of raw material and cooling, so as to transform the bed of particles into a macrosolid within said container, said macrosolid having a bulk volume not greater than 1.20 times, or with increasing preference in the order given, not more than 1.15, 1.11, 1.08, 1.05, 1.03, 1.01, or 1.00 times, the bulk volume of the particle bed from which it was formed.

It is known that exposure to electromagnetic energy in the microwave range will cause water molecules to experience an increase in rotational energy, which may subsequently be imparted to neighboring molecules or ions in the form of heat. Similarly, electromagnetic energy in the radio wave range will cause the dipoles within molecules of a susceptible material to try to orient or align themselves with the electromagnetic field, thus gaining energy. Because this Field typically reverses in excess of 10 million times a second (or in other words has a frequency of more than 10 MHz), internal friction takes place among the molecules, which can subsequently be imparted to neighboring molecules or ions in the form of heat. Particle beds processed according to this invention in fact usually become heated while being irradiated with SER.

The phenomenon of using SER is also known as dielectric heating, which is distinct from conventional heating. Conventional heating has to be applied externally and penetrates into a material by conduction. Dielectric heating, on the other hand, produces heating directly within the material, because all the molecules of the material are simultaneously exposed to high frequency electro-magnetic fields. Therefore, the "cooling" described as part of step (B) above normally begins as soon as SER irradiation is discontinued, and does not normally imply the use of any special cooling machinery, although such could be used if desired.

For each material, there is a quantitative susceptibility to the heating effects of high frequency electromagnetic energy, which can be measured as a function of frequency, and generally varies considerably depending on the frequency. Every material or material mixture therefore normally has an optimum frequency at which it is most receptive to SER energy. Theoretically, this optimum frequency is the one that should be selected for SER irradiation.

The amount of energy that a material absorbs at subinfrared electro-magnetic frequencies is known as its dielectric loss factor, "$\epsilon$", which is the product of the dielectric constant, $\epsilon$, and loss tangent, tan $\delta$. At the molecular level, the loss tangent can be considered as an indication of the average "friction" effect contributed by each polarized component, and is measured as the tangent of the phase angle between the field in the material and the applied field. Water has a very high loss factor, and is therefore particularly receptive to dielectric treatment with SER energy. By way of comparison, the dielectric loss factor for water (0.1 molal NaCl) is 18 at 3,000 MHz, in the microwave range, but it is 100 at 10 MHz (in the radio wave range). Most remaining raw material(s) of the present invention generally have much lower loss factors, and therefore will be relatively little affected by SER irradiation. This provides a useful limiting mechanism in many situations.

Scanning electron microscopy ("SEM") studies of macrosolids formed according to this invention, particularly those exposed to microwave irradiation, show a "bridgework" structure, in which the originally individual particles have been joined by sufficiently thick "bridges" to join the former particle bed into a unitary macrosolid. The macrosolid thus formed can simultaneously be described both as "hard" and "porous", due to the presence of interstitial spaces as part of this bridgework structure. While applicants do not wish to be bound by any particular theory, they believe that the heat induced in the particle bed during irradiation, perhaps accompanied by volatilization of some of the water initially present, causes a localized sintering of hydrated species alone and/or accompanied by a concomitant temporary dissolution of other species present in the raw material to form "bridges" between the initially separate particles in substantially single point contact. This bridged-type structure may account for the surprising strength and structural integrity of the macrosolids formed during most processes according to the invention.

The application of a process according to this invention to certain kinds of particle beds produces porous macrosolids with unique combinations of properties that are valuable in many applications. Accordingly, another major embodiment of this invention is a macrosolid article having the following characteristics:

(A) at least one of the following two conditions is satisfied:

(i) at least 35%, more preferably at least 50%, or still more preferably at least 60%, of the mass of the macrosolid article consists of material selected from the group consisting of alkali metal and alkaline earth metal sulfates (including hydrogen sulfates), carbonates (including acid carbonates, also called bicarbonates), silicates, optionally hydrated, the silicates preferably having a molar ratio of metal oxide to silicon dioxide in the range from 1.0:1.0 to 1.0:2.5 (thus including metasilicates, disilicates, and crystalline layered silicates), zeolites, phosphates (including condensed phosphates such as pyrophosphates and tripolyphosphates), hydroxides, borates, and citrates, with the alkali metal salts generally being preferred;

(ii) at least 5%, or with increasing preference in the order given, at least 10, 20, 30, 40, 50, 60, 70, 80, or 90%, but not more than 98 % consists of material selected from the group consisting of materials satisfying both the following two conditions: (ii.1) the material is solid at 25° C. and (ii.2) a solution of 10% of the material in water, or a saturated solution of the material in water if its solubility is less than 10%, has a pH at 25° C. of not more than 4, or with increasing preference in the order given, of not more than 3.5, 3.0, 2.5, 2.0, 1.5, 1.0, 0.5, or 0.1; and if as much as 10% of the mass of the macrosolid is made up of strongly alkaline materials, no more than 10% and preferably no more than 5% of the mass of the macrosolid is made up of strongly acid materials; and if as much as 10% of the mass of the macrosolid is made up of strongly acid materials, no more than 10% and preferably no more than 5% of the mass of the macrosolid is made up of strongly alkaline materials, a material being defined for this purpose as "strongly alkaline" if a 0.1N solution of the material in water at 25° C. has a pH value of at least 12.0 and being defined as "strongly acid" for this purpose if a 0.1N solution of the material in water at 25° C. has a pH value of not more than 2.0;

(B) at least half of the mass of the macrosolid consists of chemical species that are solid at 25° C. and are soluble or homogeneously dispersible in water at 25° C. to form solutions containing at least 10 grams per liter of the dissolved or dispersed solid chemical species; and (C) upon immersion at 55° C. in a volume of water that is at least ten times the bulk volume of the macrosolid, the macrosolid dissolves, disintegrates, or both dissolves and disintegrates, so that no part of the macrosolid remains in any single undissolved particle having a largest dimension greater than 2.2 mm, within a time after immersion that is not greater than 0.050 minutes, or with increasing preference in the order given, not greater than 0.042, 0.036, 0.031, 0.027, 0.020, or 0.010 minutes, per cubic centimeter of bulk volume of the macrosolid.

Although, as noted above, both strong acids and strong bases can be included within the materials of a macrosolid according to this invention, caution should be exercised during the manufacture of such macrosolids, because, as a result of conversion of formerly solid acidic and alkaline materials in the raw materials into molten or dissolved phases during manufacture according to this invention, exothermic neutralization reaction between materials thus freed to react with each other can cause unwanted temperature irregularities during the SER processing.

A significant advantage of a process according to the present invention is that additional pre-treatment processing steps, such as pre-heating the raw material mixtures, fluidizing mixtures, pumping heated fluids, or continuously sweeping streams of hot air through the microwave or radio wave treatment chamber, are not required. An advantage of the macrosolid tablets and blocks formed according to the present invention is that a dissolving or pre-use step is not required. The macrosolid tablet or block may be introduced directly into the cleaning space in which the product is ultimately used, especially in the areas of industrial and household cleaning, and particularly with respect to laundry and dishwasher applications.

As used herein, the term "cleaning space" is intended to encompass any space in which there is contact between a solid surface, including a textile, and a liquid, liquid slurry, or paste cleaning composition with the result that some soil material, the presence of which is undesired on the solid surface, is transferred to the cleaning composition. Thus, the cleaning space may be the tub or interior space of a clothes or dishwashing machine, a spray zone of an industrial bottle washing machine, a sink for manual dishwashing, a floor or wall and the space immediately surrounding the part of it to be cleaned, the exterior surface of a solid object and the space immediately surrounding the part of the exterior surface to be cleaned, and the like. In many cases, the cleaning composition is supplied to the cleaning area from a reservoir, which may be a stock tank in a washing machine, a spray bottle, a mop bucket, or the like.

Still another embodiment of the invention is the use of macrosolid cleaning products as described above in cleaning any of the wide variety of materials noted above. In particular, many of the macrosolid cleaner embodiments of the invention are well suited for use in a dispensing device and method of use as described in FIGS. 4 and 6–9 and in the text from column 9 line 47 through column 16 line 31 of U.S. Pat. No. Reissue 32,763 of Oct. 11, 1988 to Fernholz et al., which portions of said U.S. Pat. No. Re. 32,763 are, to the extent not inconsistent with any explicit description in this specification, hereby incorporated into this specification by reference, mutatis mutandis; in particular, the terms "cast block" and the like in the incorporated portions of U.S. Pat. No. Re. 32,763 are to be understood as replaced herein by "macrosolid cleaner" according to this invention as described above, or a solid cleaner modified by imbibition of additional material into a porous macrosolid cleaner according to this invention as described below.

The porous macrosolids produced according to the invention are also valuable in another application area. Many cleaners currently on the market exist in liquid form as concentrates or so-called cleaner "enhancers" which may contain alcohol or other organic solvents. When combined with water in a use situation, a number of such cleaners suffer from such undesirable phenomenon as phase separation and salting- or settling-out in solution. Other cleaners incorporate supplemental additives or require formulations with high water content in order to keep materials in solution during storage, transportation, etc. One disadvantage in such instances is that it is costly to transport and provide additional packaging materials for the larger required product volumes.

Certain attendant disadvantages of existing cleaner products may be overcome by combining active components just prior to the dissolution and use of a solid cleaner, such that there is insufficient opportunity for components to phase separate or fall out of solution. The macrosolids of the present invention are particularly adaptable to such an application because, as described briefly above, some of the macrosolid tablets or blocks formed according to the SER process of the current invention exhibit remarkably rapid dissolution, or a combination of dissolution and mechanical disintegration upon exposure to water. Accordingly, another major embodiment of this invention is a two-component or dual-pack article comprising, preferably consisting essentially of, or more preferably consisting of:

(A) a macrosolid according to the invention as described above; and (B) a liquid component, which may optionally contain dissolved solid substances.

In one preferred embodiment of the invention, a macrosolid and a liquid component are individually added, or combined and then added, to an appropriate amount of water to produce the desired cleaning solution for a particular cleaning application just prior to use. As used herein, the term "just prior to use" is meant to indicate that after the macrosolid component and liquid component have been combined with water in preparation for use, the resulting cleaner is preferably used within a time that is not greater than 480 minutes, or with increasing preference in the order given, not greater than 240, 120, 60, 30, 15, 5, 1, 0.50, 0.25, 0.10, 0.05, 0.025 or 0.01 minutes of the time at which the macrosolid component and the liquid component are first combined with water.

A particular advantage of the dual-pack product according to the present invention is that it permits the incorporation of certain liquids and dissolved solid substances into a liquid phase of a cleaning formulation, which for practical purposes cannot readily be incorporated into the solid component. By way of illustration, such substances might include liquid waxes or silicones, which are desirable in cleaners in the floor care area, for example.

DESCRIPTION OF PREFERRED EMBODIMENTS

Typical hydrated materials suitable for use in a process according to this invention include materials that contain water of crystallization or hydration, i.e., water molecules, present in a solid in definite stoichiometric ratio to another chemical constituent of the solid, which can be expelled in whole or in some stoichiometrically well defined part by raising the temperature of the solid and/or lowering the amount of water vapor in the gaseous atmosphere to which the solid is exposed past a specific threshold value; and materials, such as the alkali metal hydroxides, that, without necessarily having any definite stoichiometric hydrates, may contain "free" water molecule(s) in some more general association with the solid in continuously variable amounts down to near zero.

Particular hydrated compounds useful in the practice of this invention include alkali metal hydroxides, such as sodium hydroxide and potassium hydroxide; sulfates, such as magnesium and sodium sulfate; silicates, such as sodium metasilicate; phosphates, such as sodium tripolyphosphate or trisodium phosphate; carbonates, such as sodium or potassium carbonate; bicarbonates, such as sodium or potassium bicarbonate; and borates, such as sodium borate; etc.

A particularly preferred group of stoichiometrically well characterized hydrated materials useful in this invention includes sodium metasilicate pentahydrate ($Na_2SiO_3.5H_2O$), sodium carbonate decahydrate ($Na_2CO_3.10H_2O$), sodium tetraborate tetrahydrate (borax, $Na_2B_4O_7.10H_2O$), trisodium phosphate dodecahydrate ($Na_3PO_4.12H_2O$), and sodium tripolyphosphate hexahydrate ($Na_5P_3O_{10}.6H_2O$).

In some applications of the invention, it is preferred to include in the raw material in the particle bed at least 4% by volume, or with increasing preference in the order given, at least 6, 10, 16, or 25% by volume, but not more than 35% by volume, of solid material that melts at the temperature actually reached during irradiation according to processes of the invention. This readily melted material may or may not be hydrated, but often is hydrated. For example, it has been observed that borax, trisodium phosphate dodecahydrate and sodium hydroxide monohydrate all melt readily under microwave irradiation.

Another type of material that may be either hydrated or unhydrated and is often advantageously included in the raw material for a process according to this invention is the type known as crystalline layered silicates. Such materials are described in U.S. Pat. No. 4,820,439. The entire disclosure of this patent, to the extent not inconsistent with any explicit statement herein, is hereby incorporated herein by reference. In brief, crystalline layered silicates consist essentially only of sodium, silicon, oxygen, and, optionally hydrogen and are capable of acting as both alkalinizing agents and builders in cleaning formulations. For certain products according to the invention, at least 1%, or with increasing preference in the order given, at least 5, 10, 15, 20, 24, 28, 32, 35, 45, or 50% of the mass of the macrosolid article, but not more than 90% of the mass of the macrosolid article, consists of material selected from the group consisting of crystalline layered silicates. A particularly preferred crystalline layered silicate is the one described in the noted patent as "Na-SKS-6" and commercially available under the same designation from Hoechst. Crystalline layered silicates generally improve the mechanical strength and resistance to mechanical damage of macrosolids according lo the invention that contain them and also improve the rate at which such macrosolids dissolve and/or disintegrate upon contact with liquid water. Because of the first improvement noted, larger amounts of other materials which have useful cleaning properties, but tend to lower the mechanical strength of macrosolids containing them, can be incorporated into macrosolids according to this invention than would be practical in the absence of the crystalline layered silicates. Such desirable constituents of macrosolids according to the invention as abrasives, and, especially, surfactants, fall into this class of materials that can be more practically incorporated into macrosolids according to the invention when accompanied by crystalline layered silicates.

A process according to the invention utilizes as one of its inputs a plurality, usually a large plurality, of relatively small particles, which may be called powder, granules, prills, or some similar term, to make a relatively large unitary solid. In most examples of practical interest, the relatively small particles used are sufficiently small that it is impractical to count and characterize each of them individually. Therefore, all specifications herein that refer to quantitative geometrical characteristics of individual raw material particles are to be understood as satisfied by consideration of a sufficient number of individual particles as to give statistical assurance at the 90% confidence level or higher that the average of the specified geometrical characteristic for the entire particle distribution is within 10% of the value specified.

For the purposes of this description, the "largest dimension" of any unitary solid body means the largest distance possible between two hypothetical parallel planes both of which are touched by the solid body, while the "smallest dimension" of the unitary solid body is the distance between the closest of all possible pairs of two hypothetical parallel planes between which the solid body can fit. Preferably, with increasing preference in the order given, the ratio between the largest dimension and the smallest dimension of the particles utilized as raw material in a process according to this invention is not greater than 10:1, 5:1, 2.0:1.0, 1.8:1.0, 1.55:1.00, 1.42:1.00, 1.33:1.00, 1.25:1.00, 1.18:1.00, 1.11:1.00, or 1.06:1.00.

Also, independently, with increasing preference in the order given, the ratio of the smallest dimension of the macrosolid made by a process according to this invention to the smallest dimension of the raw material particles used to make it is at least 5:1, 10:1.0, 30:1.0, 120:1.00, or 600:1.00. This condition shall be considered to be satisfied if satisfied for the smallest dimension of the raw material particles used as determined by a statistical analysis as described above, or alternatively if satisfied by an "alternative smallest dimension" defined by the maximum size of the openings in a screen, cloth mesh, or like structure that has openings of a known maximum size and through which all the particles in the particle bed have been passed. Independently, it is preferred that the average size of the raw material particles used fall within the range from 1 μm to 2 mm, more preferably from 0.10 to 1.2 mm, or still more preferably from 0.10 to 0.5 mm. Independently, it is preferred that the maximum particle size of the solids used in the raw material not be, with increasing preference in the order given, greater than 1.0, 0.84, 0.71, 0.60, 0.50, 0.42, 0.35, 0.30, 0.25, 0.21, 0.18, 0.15, 0.13, 0.10, 0.088, 0.074, or 0.063 mm.

Also, independently, with increasing preference in the order given, it is preferred that at least 60, 70, 80, 87, 92, 97, or 99% of the volume of the bed of particles utilized in a process according to this invention be solid rather than liquid at the temperature of the bed before beginning irradiation with SER; and, independently, that the pore volume of the particle bed utilized in a process according to the invention fall within the range of from 1 to 50, 3 to 45, 5 to 40, 7 to 35, 10 to 30, 13 to 28, 15 to 26, or 17 to 25%, of the bulk volume of the particle bed. Independently, it is also preferred that the pore volume of the macrosolid formed at the end of process step (B) as defined above in a process according to the invention fall within the range of from 1 to 50, 3 to 45, 5 to 40, 7 to 35, 10 to 30, 13 to 28, 15 to 26, or 17 to 25%, of the bulk volume of the macrosolid.

Further, in at least one major embodiment of the invention, it is preferred that, with increasing preference in the order given, at least 35, 50, 60, 65, 76, 82, 87, 91, or 94% of the mass of the raw material in the particle bed utilized in a process according to this invention or present in a macrosolid according to this invention is selected from the group consisting of alkali metal and alkaline earth metal sulfates (including hydrogen sulfates), carbonates, hydrogen carbonates, silicates, optionally hydrated, having a molar ratio of metal oxide to silicon dioxide in the range from 1.0:1.0 to 2.5:1.0 for alkali metals and in the range from 0.5:1.0 to 1.25:1.0 for alkaline earth metals (thus including metasilicates, disilicates, and crystalline layered silicates), phosphates (including condensed phosphates such as pyrophosphates and tripolyphosphates), hydroxides, borates, and citrates. For most purposes, the alkali metal salts, particularly the sodium and potassium salts, are preferred over the alkaline earth metal salts. Stoichiometric water of hydration and reversibly bound water in solid phases are both to be considered as part of the salt or hydroxide to which they are bound in determining what fraction of the raw material particle mass is selected from this group of preferred constituents.

In many embodiments of the invention, it has been found that the most desirable products are achieved when the content of water in the raw material particle bed is in the range from 1 to 25%, or more preferably from 2 to 20%, of the total mass. In determining the percentage of water in the total mass, any water of hydration present in the solids forming the raw material particle bed is counted as water, as are any liquid water present in the bed and any additional water that would be expelled as vapor from the initially solid part of the bed upon heating the bed to 100° C., or to the maximum temperature actually reached within the particle bed during any part of the process, if such maximum temperature is known or controlled and is lower than 100° C. (This value can be determined by measuring the expulsion of water vapor from a sample of the same raw material or raw material mixture, with the same particle size for each chemically distinct constituent, as forms the raw material particle bed used in the process according to the invention.) Alternatively, the water content can be measured by a modified Karl Fischer titration method.

The SER technique of the present invention may successfully be applied to a variety of cleaning formulations such as detergents or ware-washing, prewashes, dishwasher detergents, carpet cleaners, floor care products, and general rinse/wash or all-purpose cleaners, and the like, for textiles or hard surfaces. An advantage of this technique is that the desired cleaner or detergent product may normally be obtained promptly upon the conclusion of the SER treatment.

The temperature of the particle bed at the beginning of SER treatment in a process according to this invention may be varied within wide limits, but for convenience and economy generally is preferred to be within the range of 15 to 50, more preferably from 20 to 35, still more preferably from 20° to 25° C., In addition, particularly when the raw materials used in the process include such chemicals as the alkali metal hydroxides with very high heats of solution in water, it is often advantageous in a process according to the invention to control the temperature during step (B) of the process by means of a device that discontinues or reduces the power of the subinfrared electromagnetic irradiation when a preset temperature of a suitable probe, which is electronically connected to the controls for generation of the SER radiation source used in the process and is physically located in close proximity to, preferably within 1 mm of, at least a part of the initial particle bed, is exceeded. Such preferences can not be stated on a general basis, as they depend on the particular materials processed, but guidelines can be obtained from the examples below.

If more than one chemical species makes up the solid raw material of the particle bed used in a process according to the invention, all the solid components are preferably mixed with one another to form a substantially homogeneous particle bed which is exposed to SER. Methods for such mixing will be generally known to those skilled in the art. For example, hand or mechanical stirrers and/ or shakers may be used, the roughly mixed raw materials may be passed through a grinder or other comminution device, or the like.

The duration of exposure of the raw material mixture to SER according to the process of the current invention will depend upon a number of factors, the most important of which are discussed here. These include: the power of the SER source; the initial temperature of the raw materials in the particle bed; the water content of the raw material; the temperature-sensitivity, if any, of the raw materials; the shape or configuration of the container used; and the bulk of the material contained therein. When temperature-insensitive materials are used, however, it is the time duration required to achieve a sufficient temperature—that is, the temperature at which the material is transformed from a bed of discrete particles into a unitary solid, or into a material that will constitute a unitary solid when cooled to a normal ambient temperature—that will usually govern the duration of exposure of the raw material mixture to SER. The time of irradiation normally is preferably within the range of 5 seconds (hereinafter often abbreviated "sec") to 30 minutes (hereinafter often abbreviated "min"), or more preferably from 30 sec to 20 min.

For example, exposure to microwave radiation in a MLS-1200 T device (Büchi) operating at 2450 MHz and 250 Watts for times from 2 to 4 minutes has been found to be sufficient to form 30 g tablets from raw materials that were stable to temperatures of up to 140°–160 ° C., while 250 g blocks at the same power level needed at least 12 minutes. On the other hand, 30 g tablets can be formed in 15 seconds with the same microwave radiator at 1000 watts power. With a Hotpoint Model RE600002.92KW microwave generator rated and used at 240 watts of power output, samples on the order of 400 g in size needed approximately 8 minutes, while 1–2 kg blocks may require 20 minutes or slightly more. Slightly longer times are needed if more temperature-sensitive raw materials are included in the particle bed.

It is also within the teaching of the present invention to use more than one power setting for different time periods, or to "pulse" a sample with SER radiation for short intervals, interrupted by other short intervals in which power is discontinued. "Pulsing" of this type has been found to be particularly advantageous when strongly acidic macrosolids are desired as the output of a process according to the invention. Prolonged SER-irradiation of highly acidic particle beds tends to result in oxidative decomposition of the particle bed and a consequently weak macrosolid, or often failure to form a macrosolid at all, but short pulses interrupted by periods without irradiation often overcome this problem. In such circumstances, the time for a continuous interval of irradiation preferably is, with increasing preference in the order given, not greater than 85, 60, 45, 30, 20, 15, 10, 8, 7, 6, or 4 sec, and each such continuous interval of irradiation is independently preferably followed by an interval of at least equal length in which irradiation is not applied to the particle bed. Generally, the accumulated time of actual irradiation when using the pulsing technique is approximately the same as for continuous irradiation in a single interval to form a macrosolid from other materials, but the time will obviously be adjusted as necessary by those skilled in the art. Any acid that is solid at the temperature of the particle bed can be successfully incorporated by this technique. Examples include citric, maleic, oxalic, and sulfamic acids, with the latter especially preferred for making strong acid cleaners, with a pH value of as low as about 1 for a solution containing 1% by weight of the cleaner, that are especially useful for removing difficult to remove soils such as cement residues.

Measurements of the dielectric parameters made by means of a Hewlett-Packard HP85070M Dielectric Probe Measurement System have demonstrated that radio wave irradiation is suitable for a number of raw material mixtures as shown in Table 1. In all three cases, the dielectric loss factor, $\epsilon$, in the radio wave range is higher than in the microwave range, suggesting that the time required to form macrosolids of a particular composition via radio wave irradiation according to the present invention should be less than the amount of time required for formation of macrosolids via microwave radiation. With increasing preference in the order given, the time required with radio wave irradiation will be no more than 2.0, 1.75, 1.5, 1.25, 1.0, 0.75, 0.25 or 0.01 times the amount of time required for formation of macrosolids via microwave radiation.

TABLE 1

Frequency Dependence of Dielectric Loss-Factors, $\epsilon$, for Three Raw Material Compositions Measured at Room Temperature

| | Dielectric Loss-Factor, $\epsilon$ | |
|---|---|---|
| Composition | 200 MHz (Radio Wave Range) | 2,000 MHz (Microwave Range) |
| Composition 1 (Perclin ™ Supra) | ~13.5 | ~2.5 |
| Composition 2 (Sekumatic ™ PR) | ~1 | ~0.5 |
| Composition 3 (Imi ™-powder) | ~1 | ~0.5 |

Macrosolid tablets and blocks according to the present invention preferably contain at least 0.1 percent, but more preferably at least 2% of water up to 15, or more preferably up to 11%, of water, the difference, if any, in water content before and after the subinfrared electromagnetic irradiation being believed to be due to the evolution of some water which usually accompanies the process. More preferably, the macrosolid products of some processes of the present invention contain from 0.5 to 10 percent of water, and still more preferably from 2 to 6 '%o of water. The amount of water present in the macrosolid product may be determined by a conventional modified Karl Fischer titration, which may be carried out as described in the indented paragraphs immediately following below. This method determines the amount of water volatilized from the sample by heating to 200° C., including any water which is generated as a result of any possible decomposition reaction that occurs, (e.g., the decomposition of perborate). The method is accurate to about 0.1% of water content.

Principle of the Method: Water is volatilized from the sample material to be tested by heating to 200° C. in a special drying oven. The water vapor released is transferred in a dry nitrogen stream into an connected automatic Karl Fischer titrator and therein is titrated.

Apparatus; The apparatus consists of a special drying oven (Metrohm™ E 613) and an automatic Karl Fischer Titrator (e.g., Metrohm™ E 452). The outlet from the oven is connected by a glass tube with an inlet capillary tube in the titration container of the titrator.

Nitrogen supply: Conventional compressed nitrogen in a steel tank is used. The pressure is reduced with the help of a pressure reducing valve to about 2.5 kilopascals/$cm^2$. The outlet from the tank valve is connected via a hose, made of polyethylene and reinforced with glass fibers, to a gas flow meter, equipped with a control valve; after the gas flow meter, an empty safety washing bottle is placed in series, followed by a gas washing bottle containing concentrated sulfuric acid.

The washing bottle is connected to a tubing tee, from which one branch leads to a safety pressure-relief valve, e.g., a washing bottle highly overfilled with sulfuric acid, prior to which again an empty safety bottle should be inserted in a serial connection.

From the other branch leading i:from the tee, a connection with the drying oven is made via a glass tube, which is perfectly fitted and which is provided at the end with a spherical ground glass joint. No silicone hose or polyethylene hose may be used in place of the glass tube, as otherwise at high air humidity water will diffuse into it and cause an erroneously high value for water.

Drying oven: The drying oven can be in essence used as delivered; however, the gas inlet and the gas outlet on the internal attachment piece should be provided with a spherical joint.

Connection between the drying oven and the Karl-Fischer-titrator: The connection between the drying oven and the titrator consists of a glass tube provided with spherical joints, the internal diameter of the tube being 1.5–2 mm and the glass tube being attached to an inlet capillary tube of internal diameter of 1.5 mm, also provided also with a spherical joint. These parts are preferably manufactured specifically for this purpose and are adjusted to fit the spatial conditions and/or the titration container. The interconnecting tube may be omitted, if the spatial placement of the apparatus permits it. The connecting passageway between the oven and the titrator preferably is provided with a heating device, such as a strip heater or the like, which allows heating up to 80°–100° C., because the water can otherwise condense out in this zone.

Karl Fischer Titrator: A Karl Fischer titrator consists of 3 subunits, the titration container with a stirring device, the control and measuring electronics, and a dispenser, e.g., Metrohm Dosimat™ E 655. The cover of the titration container is provided with 5 passages. From among them, the first opening is used for the reading electrode, the inlet capillary tube is led into the second opening, the third is provided with a rubber stopper with a hole drilled through, into which a thin polyethylene hose of internal diameter of about 1–2 mm is inserted deep enough that it reaches into the titration container up to about 3 centimeters (herein often abbreviated "cm") above its bottom. The other end of the hose leads to a waste container for solvents. The inlet for the Karl Fischer reagent is connected with the fourth opening, and the fifth opening is provided with a ground joint stop-cock. All passages must be sufficiently tightly fitting to avoid penetration by water vapor in the air.

The performance of water determination: The drying oven is preheated to 200° C., and the heating of the connecting pipe between the oven and the titrator is also begun. The nitrogen feed is opened and controlled so that about 60 ml/min of nitrogen gas flow through the equipment, and the ground joint stopcock located in the cover of the titration container is also opened. Fifty ml of methanol is introduced into the titration container, the titrator is switched on and the methanol is titrated. A one-component Karl Fischer reagent is used as the titration agent, the pyridine-free Hydranal Composite™ of Riedel de Haen Company having proved satisfactory. When the equipment is completely sealed, the blank consumption after the methanol titration must be below 0.4 ml/h.

The titrator is set to switch off after 30 seconds of operation. With the help of a 50 $\mu$l syringe, 50 $\mu$l of water is added to the methanol previously titrated and the titration is started again. The coefficient "F" of the reagent solution is calculated from the equation:

$$F = \frac{10}{\text{consumption reading}}$$

This factor determination should be repeated at least three times, then an average from the obtained values should be calculated.

If the titration container after the completion of the titration is more than ⅔ full, the stopcock in the cover is closed. The overpressure, building up subsequently, will propel the liquid through the polyethylene hose into the solvent waste container, until the liquid level reaches the lower edge of the PE hose, then the stopcock in the cover is opened again.

Water determination in detergents and cleaning agents: The sample of which the water content is to be determined is placed in a small steel boat (about 6 cm in length×1.5 cm height×1 cm width). If no small steel boat is available, a small boat of comparable measurements can be shaped from a strip of aluminum foil of 0.5 mm thickness. Into the boat, 300–500 mg of the substance to be analyzed is weighed. For liquid alkaline samples a glazed porcelain boat should be substituted.

The small boat is introduced into the oven heated to 200° C., the titrator is pre-set for 30 sec operation and the titration is started. During this process it should be carefully assured that the methanol used had already been titrated.

Depending on the substance, the titration is completed after 10 to 20 minutes, the titrator automatically switches itself off, and the value is recorded.

The water content of the substance is calculated as follows:

$$\% H_2O = \frac{\text{ml consumption} \cdot F \cdot a \cdot 100}{E},$$

where a=the theoretical titer of the Karl Fischer reagent, F=coefficient of Karl-Fischer-reagent, and E=sample mass in mg.

Reproducibility: The standard deviation for this determination, from 6 replications on one sample with a mean value of 20.5% water, is 1.1%. relative.

The invention includes within its scope the formation of macrosolid tablets or blocks which are formed from a mixture of raw materials containing all or nearly all of the necessary components for a cleaner formulation. In general, the ingredients and the relative proportions in which they are used in macrosolid cleaners according to this invention are substantially the same as those intended to be used for the same purposes in other solid cleaners of the prior art. The cleaner formulations suited to the present invention include all-purpose cleaners, detergents, industrial or institutional cleaners, ware-washing cleaners and automatic detergents for textile or hard-surface cleaning purposes. In one embodiment of the invention, it is possible to form macrosolid cleaner or macrosolid detergent tablets or blocks directly from raw material mixtures in disposable packaging, which constitutes the container during processing. Water-soluble films may be used for the disposable packaging, as discussed further below. The macrosolid tablets or blocks of the present invention may further comprise one part of a multiple part cleaning combination.

In yet another embodiment of the invention, it is possible to after-treat tablets, blocks, or molded macrosolids in which a particular component, such as a microwave-sensitive substance such as an enzyme, or a surface coating designed to impart certain properties, such as slower dissolution, for example, is excluded from the raw material mixture prior to treatment. The SER technique permits the use of these substances by incorporating them into the porous product from the end of step (B) in a process according to the invention as defined above, due to the porous structure in the SER macrosolid thus formed. Accordingly, substances such as those commonly used for coatings on cleaner blocks to protect against skin contact (i.e., materials such as poly{alkylene}s, especially poly{ethylene}; poly{alkylene glycol}s, especially poly{ethylene glycol}; fatty acids; fatty acid amides; paraffin waxes; sorbitol; carbohydrates such as sucrose; and nonionic surfactants) can be successfully incorporated into the initial macrosolid product by dipping macrosolid blocks or tablets into appropriate liquid compositions and then drying some or all of the liquid constituents into a solid contained within the pores of the initially produced macrosolid.

Other conventional techniques such as spraying or otherwise applying the component onto the SER macrosolid are also possible due to the open space structure of the SER-formed products. On the other hand, if only a surface protective coating is desired, imbibition of the coating material into the pores and interstitial spaces of the macrosolid cleaners produced according to this invention may be minimized by coating with a relatively viscous coating material. Providing protection against unwanted contact with the skin of users of the macrosolid products of this invention, as with similar conventional products of the prior art, is important for safety when the cleaners are strongly alkaline in composition.

In this respect, the SER technique of the current invention presents a distinct advantage in the formation of macrosolid products over several prior art techniques. For example, in the formation of tablets by prior art techniques that involve elevated pressure, the structure of the resulting solid product is such that the solid cannot readily absorb additional materials once the tablet has been formed. Where an after-treatment or incorporation of a SER-sensitive or heat-sensitive material is desired, the open structure of the SER produced macrosolids permits incorporation of substances through permeation of these interstices. In this way, a broader range of products in macrosolid form, including products with most or all of the pores present in the initially formed macrosolid filled with some solid material, may be achieved with the SER process of the current invention than is possible with conventional techniques.

In addition to the preferred materials already described above, other materials that are suitable and useful for at least some applications as part of the raw material particle bed for a process according to this invention include the usual nonionic, anionic, cationic and zwitterionic surfactants and mixtures thereof. The surfactant or surfactants chosen for use as constituents of the particle bed in accordance with the present invention in general comprise no more than 25%, and preferably no more than 15%, of the total raw material mixture, unless the latter includes substantial amounts of crystalline layer silicates, in which case the amount of surfactant may be increased to as much as 60%. However, if desired, as it is for certain products according to the invention, additional surfactant can be added by imbibition into the pores and interstitial spaces of the initially produced macrosolid product according to this invention.

Silicates that are useful in the process of the present invention include alkali metal metasilicates, where the alkali metal is preferably sodium. Preferred sodium metasilicates include the anhydrous form as well as sodium metasilicate. $5H_2O$. Silicates may preferably be present according to the present invention in amounts from 0 to 90%. Hydrated forms of sodium silicate, particularly sodium silicate.$5H_2O$, were found to aid in the SER solidifying process when used in ranges of at least 1 percent but less than 50 percent, and preferably between 1 to 30 percent. Also, as already noted above, crystalline layer silicates are often highly preferred and advantageous constituents of the particle beds to be consolidated according to this invention.

Phosphates that may be used in the SER process of the present invention include alkali metal tripolyphosphates, hydrogen phosphates and pyrophosphates, either in anhydrous or hydrated forms or a combination thereof. The preferred, alkali metal is sodium. Preferred sodium phosphates include anhydrous sodium tripolyphosphate ("STPP"), STPP.$6H_2O$, and trisodium phosphate (TSP) $10H_2O$. Phosphates may preferably be used in amounts of up to 80%. Borates that may be used in the SER process of the present invention include alkali metal borates, either in the hydrous or anhydrous forms or a combination thereof. The alkali metal is preferably sodium. Preferred sodium borates include sodium borate.$10H_2O$ (borax). Borates may preferably be present in amounts of up to 20%, and thus are preferably used in combination with at least one other raw material.

Carbonates and bicarbonates that may be used in the SER process of the present invention include alkali metal carbonates and alkali metal bicarbonates, either in the hydrous or anhydrous forms, or a combination thereof. The alkali metal is preferably sodium or potassium. Preferred sodium carbonates include anhydrous sodium carbonate and sodium carbonate.$10H_2O$. The preferred bicarbonate is anhydrous, and sodium is the preferred alkali metal. Suitably hydrated carbonates may preferably be used in amounts of up to 100% of the total raw materials mixture. Bicarbonates, which are also known as hydrogen carbonates or acid carbonates, may preferably be used in amounts of up to 40%, and are thus preferably used in combination with at least one other raw material. Where bicarbonates are used in formulations for promoting hygiene, they are preferably used in amounts of up to 20%. Where bicarbonates are used for dishwasher formulations, they are preferably used in amounts from 5 to 40%. In certain cases, it is preferable to avoid using bicarbonates in the same raw material mixture as either carbonates or citrates.

Alkali metal hydroxides may preferably be present in amounts of up to 80 percent, and more preferably from 2 to 70 percent. Preferred hydroxides include sodium and potassium hydroxide. For applications in the kitchen hygiene area, or wherever tablets with high alkali content are especially desired, the process of the present invention offers several advantages over prior art techniques. The manufacture of solids containing high alkali content is not practical using pressing techniques of the prior art, for example, due to moisture accumulation which occurs on the pressing apparatus during the process. This is particularly bothersome where formulations containing both sodium hydroxide and perborate are desired, to the extent that the manufacture of pressed tablets containing such compositions is believed never to have been practical. Furthermore, it is not possible to mechanically press tablets with high alkali content when there is greater than 80% moisture present in the air. The microwave process of the present invention is not affected by either of these conditions, and macrosolid tablets that are not only high in alkali content, but that also contain perborate, have successfully been obtained.

Sulfates that may be used in the SER process of the present invention include alkali metal sulfates and alkaline earth sulfates (in both cases including hydrogen sulfates), although calcium sulfate is only rarely used because of its low solubility. Alkali metal sulfates are preferably used in the non-hydrated form; alkaline earth sulfates are preferably used in the hydrated form. Sodium is the preferred alkali metal for alkali metal sulfates, and magnesium is the preferred alkaline earth metal for alkaline earth sulfates. When an alkaline earth sulfate is used in the hydrated form, the preferred alkaline earth sulfate is $MgSO_4.7H_2O$. Alkali or alkaline earth sulfates may preferably be used in amounts of up to 80% of the raw material, but more preferably are used in amounts of 1 to 30%.

Citrates that may be used in the SER process of the present invention include hydrated and non-hydrated alkali metal citrates, and sodium is the preferred alkali metal. Especially preferred citrates are the mono-, di-, and pentahydrates of trisodium citrate. Alkali metal citrates may preferably be present in amounts of up to 95 percent of the total solid raw material, and are especially preferably used in amounts of 30 to 50% for general cleaning formulations. With respect to some formulations for use in the dishwashing area, citrates are more preferably used in amounts of 80 to 90% of the total solid raw material.

Nonionic surfactants that may effectively be used in the SER process of the present invention include those commonly used solid cleaners of similar chemical composition in the prior art, such as alkyl-, arylalkyl-, alkylaryl-, and aryl-polyoxyalkylenes, esters and amides of polyoxyalkylated alcohols, and poly{alkyl glucosides}, preferably ethoxylated fatty alcohols and ethoxylated alkyl phenols. In some particular applications, the most preferred ethoxylated fatty alcohol is tallow alcohol condensed with an average of 14 moles of ethylene oxide per mole of tallow alcohol (this alcohol-ether is hereinafter often abbreviated "TA 14") and the preferred ethoxylated alkyl phenols are nonylphenol ethoxylates such as NPE 9.5 (with an average of 9.5 molecules of EO per molecule of nonyl phenol). Non-ionic surfactants may preferably be present in amounts of up to 25 percent, and more preferably in amounts of 0.1 to 15%, in the absence of crystalline layer silicates, but may be present in amounts of up to 60% in the presence of the latter.

Anionic surfactants that may be used in the practice of the present invention include alkane sulfonates, a-olefin sulfonates, fatty acid sulfonates, fatty alkyl sulfates, fatty alkyl ether sulfates, sulfosuccinates, fatty alkyl ether carboxylates, isethionates, taurides, sarcosides, fatty acid sulfates, sulfonamidocarboxylates, salts of partial organic esters of sulfuric and phosphoric acids, salts of sulfated esters and amides of carboxylic acids, with a preferred group including fatty acid sulfates, Mersolat™ 95, and linear alkylbenzene sulphonates. Anionic surfactants may preferably be present in amounts up to 25 percent, and more preferably from 0.1 to 10%, in the absence of crystalline layer silicates, but may be present in amounts of up to 60% in the presence of the latter.

Cationic and zwitterionic surfactants may preferably be present in amounts of from 0.1 to 25%, and more preferably from 1 to 15% of the total raw material mixture. Typical raw materials of this type, all of which are suitable for use in this invention, include amine oxides, amidazolinocarboxylates, betaines, and amino-carboxylic acids for zwitterionic surfactants; and primary, secondary, tertiary, and quaternary ammonium salts, such as alkanolammonium, imidazolinium, quinolinium and isoquinolinium salts, and thiazolinium salts as well as the more common fatty ammonium salts, along with sulfonium and tropylium salts, for cationic surfactants.

Optionally, the raw material mixture of the current invention may also contain additives and auxiliaries. Additives preferably are present in amounts not greater than 60%, more preferably not greater than 40%, or still more preferably in amounts of 0.5 to 15%. Examples of suitable additives include, but are not necessarily limited to: active oxygen sources and oxidizing materials; activators for active oxygen sources; active chlorine sources and chlorine-containing materials; enzymes; sequestrants; fillers and builders; abrasives; turbidity promoters; dispersants and dispersing agents; corrosion inhibitors; and disinfectants.

Auxiliaries may preferably be present in amounts of up to 10%, and are more preferably used in amounts of 0.1 to 2%. Examples of auxiliaries include, but are not necessarily limited to: perfumes; optical brighteners; dyes and pigments; defoamers and foam inhibitors; solubilizers; anti-redeposition agents, and dye transfer inhibitors.

With respect to additives that may be used in the current invention, chlorine and oxygen sources may be effectively used either coated or uncoated, and may be added directly to the raw material mixture in either form. Alternately, these materials may be incorporated into the SER-formed product subsequent to initial macrosolid formation. Another advantage of the present invention, therefore, is that unlike prior art techniques for casting or molding solid detergents, the SER process of the present invention does not require that chlorine-containing components be included as a preformed plug, cartridge, or core.

Typical chlorine sources that may be effectively used according to the present invention include chloroisocyanurates such as di- or tri-chloroisocyanurates, and polychloroisocyanuric acids. Two examples of the latter include CDB-56™ (available from Olin) and ACL-90™ (available from Monsanto). In the present invention, chlorine sources may preferably be present in amounts of up to 30 percent, and more preferably from 1 to 5 percent. It has been found that raw material mixtures that incorporate chlorine sources tend to exhibit temperature sensitivity during the microwave process, and where such materials are used, temperature controls should be preferably implemented such that the raw material mixture does not exceed a particular temperature. In the case of chlorine source materials, it was determined that temperatures should preferably be kept under approximately 383° K (110° C.).

Active oxygen sources are typically used in powder or granular detergent formulations, but their use in uncoated form in the present process generally is not preferred, although both coated and uncoated forms have successfully been used in the present invention, with careful temperature control. If the raw material mixture achieves too high a temperature during certain SER treatments, uncoated oxygen sources or oxidizing sources such as sodium perborate or sodium percarbonate have been observed to decompose, accompanied by the evolution of gas3, which caused foaming in the sample being irradiated. Accordingly, temperatures for raw material mixtures containing oxygen sources should preferably be kept under approximately 343° K (70° C.) during microwave processing according to this invention. Short pulsed intervals of irradiation interrupted by intervals without irradiation may be effectively used for such temperature control, as already noted.

Coated oxygen sources, however, have surprisingly been found to demonstrate good compatibility with the SER technique, and tablets and blocks containing coated perborate or coated percarbonate have successfully been produced directly from pre-mixtures containing these raw materials. Coated forms of oxygen sources are especially preferred in applications where strongly alkaline formulations are desired. The use of these coated compounds as an active oxygen source in the process of the present invention is therefore preferred. Perborates, percarbonates, or other conventional oxygen sources may preferably be present in amounts up to 30 percent, and more preferably from about 5 to about 25 percent. Perborates preferably used have the general formula $MBO_3 \cdot yH_2O$, where M is an alkali metal, most preferably sodium, and y is a number from 1 to 4.

In addition to the active oxygen sources themselves, it is often advantageous to include in the particle bed to be consolidated according to this invention and/or in the macrosolids produced according to this invention one or more materials from the class known in the cleaner art as "activators" or "bleach precursors". Suitable such materials include pentaacetyl glucose ("PAG"), 1,5-diacetyl-2,4-dioxohexahydro-1,3,5-triazine ("DADHT"), and N, N, N',N'-tetraacetyl ethylene diamine ("TAED"), with the latter preferred. Amounts of these activator materials are preferably from 1–10% in particle beds or macrosolids that also contain active oxygen sources.

Also belonging to the category of additives in the current invention are enzymes. Where enzymes are used directly in the raw material mixture of the invention in solid form, they preferably feature a coating or encapsulation. Uncoated enzymes that are commercially available in fluid form may also be used. Alternately, enzyme solutions may also be incorporated into the macrosolid SER tablet or block at a point in the process subsequent to SER treatment. This incorporation is possible in the present invention because of pores and/or interstitial spaces which are formed in the macrosolids during exposure to SER radiation. These internal spaces permit the adsorption of enzymes, or any other material, directly into the macrosolid tablet or block. According to one embodiment of the present invention, where the final product contains enzymes, they may preferably be either amylases or proteases. If desired, the enzymes may be conventionally coated, as with sulfate coatings, to protect them from adverse interactions with other constituents of the raw materials used. Enzymes may preferably be present in amounts up to 10 percent, and more preferably from 0.1 to 5 percent.

The technique of the present invention represents a distinct advantage over melt-block processes for the production of enzyme containing detergent formulations of the prior art. Since the SER process of the current invention may be implemented for short durations—minutes or even seconds, depending upon composition and size as discussed above—enzymes such as lipases, cellulases, proteases, and amylases may be directly incorporated into the macrosolids produced by this technique.

As indicated above, other conventional detergent or cleaner components may also be used as additives to the raw materials mixtures according to the SER process of the invention in addition to active oxygen sources, activators for these active oxygen sources, chlorine sources, and enzymes. These substances include: sequestrants; fillers and builders; abrasives; turbidity promoters, dispersants and dispersing agents; corrosion inhibitors; heavy metal scavengers; waxes; and disinfecting substances.

Examples of builders are phosphonates and polycarboxylates (i.e., alkali metal salts of homo- or co-polymers of acrylic acids), which may preferably be present in amounts of up to 30 percent, and are more preferably used in amounts of 1 to 15 percent; crystalline layer silicates, which may be used in amounts up to 90%; and zeolites which may be used in amounts up to 60%, preferably in amounts of 10 to 40%.

Abrasives that may preferably be used according to the present invention include such substances as marble, quartz, and alumina powders, preferably of the polishing grit or particle size, and they preferably are present in amounts not greater than 60%, or more preferably not greater than 40%. In one particular embodiment of the present invention, it is possible to include abrasives of varying size directly into the raw material particle bed prior to SER treatment, based on the application desired for the final product. The incorporation of abrasives directly into the particle bed therefore constitutes an advantage over milk-type scouring products (also called scouring creams) of the prior art. Prior art products often have sedimentation problems due to the presence of scouring powders and granular solids in the milk liquor, which settle with time. In order to overcome these problems, prior art scouring creams often require the use of suspension agents, which subsequently introduces a second problem. That is, the use of a second, surfactant-containing cleaning product is often required in order to wash away the scouring powder and granules after use of the first scouring cream. This may further introduce rinsing problems. The SER technique of the present invention avoids both problems, as scouring powders and granular solids of different sizes may be incorporated, along with a surfactant, directly into a raw material pre-mix formulation. Not only does this reduce the number of steps that may be required in a particular cleaning operation, it also reduces the number of items and therefore attendant packaging materials required.

Turbidity promoters include preferred styrene-vinylpyrrolidone copolymers in addition to other usual turbidity promoters. Dispersants include, among known dispersants, especially naphthalene sulfonic acid condensation products. Preferred corrosion inhibitors include such materials as technical 2-buten-1,4-diols (available from Colus). Preferred heavy metal scavengers include phosphonates, nitrilotriacetic acid ("NTA"), and ethylene diamine tetraacetic acid ("EDTA"). Waxes preferably are present, if at all, in amounts not greater than 5 percent, and more preferably in amounts from about 0.1 to 2 percent. Disinfectants include the normal disinfecting substances that would be known by one familiar with the cleaning arts, and may be used in conventional amounts.

Perfumes, optical brighteners, dyes and pigments may preferably be used in amounts of up to 3 percent, and more preferably from 0.001 to 1 percent. Where foam inhibitors or defoamers are used, they may be mixed directly with the raw materials of the particle bed. One advantage over prior art techniques of casting or molding solid detergents is that according to the SER process of the present invention, it is not necessary to include the foam inhibitor component as a preformed plug or core, as has been taught in some prior art.

Dedusters and defoamers such as paraffin oil and silicone oil respectively, for example, may be present in amounts of up to 5 percent, and are preferably present in amounts of 0.1 to 3 percent. Anti-redeposition agents may be present in amounts of up to 5 percent, and are preferably present in amounts of 0.1 to 3 percent. The preferred anti-redeposition agent is carboxymethyl cellulose (CMC). The preferred solubilizers are alkyl carbonic acids, cumene sulfonates, and toluene sulfonates, although other solubilizers known to those familiar with the cleaner arts are also suitable. Dye transfer inhibitors may also be used in amounts of up to 5 percent, and are preferably present in amounts of 0.1 to 3 percent. The preferred dye transfer inhibitor is poly{vinyl pyrrolidone} ("PVP").

When the particle bed to be irradiated according to the invention contains materials likely to emit gas at elevated temperatures, such as enzymes, active oxygen sources, activators for active oxygen sources, or sodium bicarbonate, irradiation under reduced pressure may be advantageous.

In certain embodiments of the present invention, a separate liquid phase component can be used in combination with a macrosolid component produced by the SER process of the invention, resulting in a two component or "dual-pack" product system. Generally, in the liquid phase component of such dual-packs, the ingredients which are used according to this invention are substantially the same as those intended to be used for the same purposes in other liquid cleaners of the prior art. The proportions can be varied therefrom, however, as it may not be necessary to include water, or at least the same amount of water as is required in prior art liquid compositions, as water will be introduced to the liquid component and macrosolid just prior to use. Moreover, another feature of such a dual-pack embodiment is that it is possible to manufacture more concentrated products than is possible in the prior art, without having to compromise final product quality.

In certain preferred embodiments, the liquids used in the dual-pack embodiment are selected from the group consisting of known nitrogen-containing solvents such as ammonium hydroxide or ethanolamines, propylene glycol ethers and glycol ether solvents such as Propasol solvent B (Union Carbide), monophenyl glycols such as phenoxy ethanol, and salts of cumene sulfonates, toluene and xylene-sulfonates, with the sodium salt generally being the preferred constituent, such as sodium cumene-sulfonate (40% aqueous solution). In general, all the usual water-dispersible materials and solubilizing agents, such as alcohols, can also be used.

It is also anticipated that for certain applications, it may be desirable to include certain dissolved solids in the liquid component of the dual-pack embodiment according to the present invention. Such may be the case, for example, if a material is not amenable to treatment by SER and therefore cannot be incorporated into a macrosolid produced according to the process of the invention, or is for reasons of convenience or handling, it is more advantageous to include such material in the liquid component phase of the dual-pack product. Examples of such materials include low-boiling alcohols, ethanolamines and perfumes with low boiling points that can be evaporated off during treatment by SER. In other instances, it may be desirable both to dissolve certain solids in the liquid component and also to include them in the macrosolid component of the dual-pack product. One example of such a material is potassium hydroxide. In yet additional embodiments of the invention, it is possible to combine a macrosolid cleaner with different dual-pack fluid components, or to use a particular dual-pack fluid component with different macrosolid cleaners in order to achieve a desired result. These and other variations will be apparent to those skilled in the pertinent art.

The maximum temperature that is acceptable for the SER process of the present invention will be below the decomposition temperature of any temperature-sensitive materials, such as oxidizing materials or chlorine-containing materials, that are present in the raw material processed.

In contrast to the press-forming of detergent tablets, it has been found that the SER process of the present invention can be used to produce macrosolid products of virtually unlimited size. It will be appreciated by those knowledgeable in the relevant field, however, that certain practical constraints exist. The power of the SER source, the size of the SER chamber, and the internal temperature that can be attained in a sample within a convenient and economically practical amount of time are all factors that determine the optimal size particle bed to be used. For example, it has been successfully demonstrated that raw material samples ranging from 10 grams to several thousand grams can be conveniently and reproducibly exposed to microwave radiation for times as short as one to two minutes up to approximately twenty minutes in order to yield tablets or block macrosolids according to the process of the present invention. The descriptions and examples contained below contain further guides for successfully practicing the SER method of the present invention.

It has also been found that the shape of the container used to hold the particulate starting raw materials can be optimized in order to enable production of the most advantageously stable macrosolid tablet or block formed. The container used is generally open at the top to permit the escape of volatilized water that is generated from the sample during SER treatment. Where the open end or open portion of a container has an area "A", the ratio of the square root of A to the depth "D" of the particle bed, i.e., the maximum distance, in a direction perpendicular to the plane of the area "A", that is within the particle bed, is preferably within the range from 1:2 to 10:1, or more preferably from 1:1 to 5:1. This range of ratios permits formation of macrosolid blocks as well as "flatter" disc-shaped macrosolids that are surprisingly strong and exhibit good integral strength, without compromising physical strength, so that the product can be conveniently handled without being readily broken or producing much powder.

Virtually any configuration may be used for a container in order to produce a macrosolid tablet or block according to the present invention. A variety of particular forms may be desired, for instance, based upon different machine applications. The dimensional constraints for the tablet or block will depend upon the path that water molecules must travel in order to escape from the bulk raw material mixture as part of the SER process, and the length of time that exposure to SER is needed before exceeding the temperature stability of any of the raw materials. Where a particular cleaner tablet or block shape is desired that does not meet the above optimal dimension criteria, such shape is still possible, providing that there are sufficient openings made in the sides or at the periphery of the container to permit the evolution of water molecules from the bulk of the raw material mixture during SER treatment.

The method of the invention is readily adapted for use on a continuous basis, wherein a plurality of initial particle beds in a plurality of containers is continuously introduced, by a conventional conveyor for example, into a SER heating zone and the resultant macrosolid product is continuously removed from said zone, or from an intermediate cooling zone, in macrosolid form. Not only is it possible to employ reusable containers with the process of the present invention, but actual shipping or handling containers can also be used as the containers during the SER processing in order to streamline the production and packaging processes.

In one embodiment of the present invention, a container of a water-soluble film material is used. The container preferably retains an opening to permit the evolution of water molecules from the raw materials during SER treatment, and can be sealed in a subsequent step. In yet another embodiment of the present invention, the container is a light-weight packaging or a thin polymer-type material, which may be especially desirable for dispensing purposes in connection with the use of larger block macrosolids. In still another embodiment of the present invention, rigid or flexible bags are used as containers.

In one embodiment of the invention when the container is a reusable one, it is advantageous to use a container with walls that are capable of reversibly adsorbing and/or absorbing water. This promotes more rapid solidification of the particle beds used in such containers. In a variation, several such containers on a continuous belt that circulates in and out of the SER cavity, and optionally to another source of high temperature to drive out water from the container walls while the containers are empty, are used.

The dimensions of the final tablet or block macrosolid that is produced according to the present invention will, as indicated above, depend upon the initial sample size and the shape of the receptacle mold or container used. Thus, a sample of 30 g of raw material that was exposed to microwave radiation in a 100 ml Petri dish gave rise to a tablet on the order of 5.4 cm in diameter by approximately 2.0 cm in height. A macrosolid cylindrical block formed from a 250 g sample had dimensions of approximately 6 cm for both diameter and height. The dimensions for a cylindrical block formed from 1 kilogram of raw materials were approximately 16 cm in diameter by 4.5 cm. Dimensions for other size tablets and blocks may be found in the examples below.

The tablet or block macrosolid formed via the SER process may usually be conveniently and readily removed from a reusable solidifying container by merely inverting the container to dislodge the item thus produced. If desired, a releasing agent such as a silicone spray may also be used to pre-treat the mold before the raw material mixture is introduced in to the mold.

As already briefly noted above, it has been surprisingly found that some of the macrosolid tablets or blocks formed according to the SER process of the current invention including conventional water soluble alkaline cleaner materials and/or crystalline layer silicates exhibit remarkably rapid dissolution, or a combination of dissolution and mechanical disintegration, upon exposure to water. In comparison studies, microwave macrosolids produced by the current invention exhibited dissolution rates that were at least an order of magnitude faster than commercially available solids. Thus, blocks on the order of hundreds of grams up to kilogram size have been shown to disrupt and dissolve readily when dropped into a beaker of water. One 400 g sample fell completely apart and was entirely flushed out of the dispensing chamber into which it had been placed. The bottom of the sink into which the material was dispensed had a build-up of undissolved material from the block. The macrosolid block therefore allows for easier handling than a powder and has similar—if not better—dissolving characteristics. This further provides for less opportunity for operator exposure to partially dissolved tablets or blocks. From the foregoing, the fact that such SER-produced macrosolid blocks offer certain conveniences in handling and shipping would therefore be appreciated by those knowledgeable in this field. Specific comparison data for relative dissolution/disintegration rates are given in Table 2 below.

For additional handling convenience or modification of the block properties, it was discovered that a thin coating layer of poly{ethylene glycol} (hereinafter often abbreviated "PEG") can be introduced into blocks consolidated via the SER technique of the present invention. By way of example, either the blocks were dipped into melted PEG after microwave treatment, or PEG was added to

TABLE 2

Relative Dissolution Rates of Commercially Available Cleaner Tablets Compared to Microwave Macrosolid Tablets Prepared by a Process of This Invention

| Sample used/Use | Sample Mass (gm) | Time for tablet to completely dissolve (min.) |
|---|---|---|
| Topmat Tabs ™/industrial | 40 | ~5 (fresh tablet) |
| | 40 | 8–10 (older tablet) |
| Topmat ™ Dos extra/ind. | 60 | 23–26 |
| Somat ™ Tabs/household | 35 | 20–23 |
| Somat ™ Supra Tabs/h.hold | 25 | 13–15 |
| Calgonit ™ Tabs/household | 18 | ~2 |
| Huy ™ Tabs/household | 20 | 8–10 |
| Example 1.1 (below) | 30 | ~0.2 (9 seconds) |
| Larger scale product, with the same materials as Example 1.1 | 230 | ~0.8 (50 seconds) |
| Example 1.2 (below) | 30 | ~0.2 (14 seconds) |
| Example 1.6 (below) | 30 | ~0.7 (40 seconds) |
| Example 1.11 (below) | 30 | 0.3–0.4 (20–25 sec.) |

Notes for Table 2
Dissolution rates were measured in 1 liter of stirred tap water at 55° C.
The Calgonit ™ Tabs contain special disintegrating promoting agents.

the raw materials in powder or flake form prior to microwave treatment. In this manner, PEG of various molecular weights may be incorporated into larger macrosolid blocks. In particular, PEG 900, 1450, 3350, 8000, and 20,000 (the numbers representing weight average molecular weights of the PEG) all gave acceptable results via either of the above incorporation techniques. It should also be recognized that, where desired, a combination of the dipping or incorporation techniques is also possible, and would be consistent with the teaching of the present invention.

Macrosolid blocks that were dipped into PEG were exposed to the molten substance for times that varied from approximately five to approximately sixty seconds. One hundred gram samples were prepared that contained an additional 10 to 36 g of PEG in the raw materials prior to microwave treatment. Dispensing rates for PEG-treated blocks—either coated with PEG or with PEG incorporated therein—were then compared. In general, PEG coated blocks dispensed at a somewhat slower rate than analogous blocks containing solidified PEG in the raw materials.

Typical Methods of Making Products According to the Invention

While the following processes are described with reference to specific components, it should be understood that other components and similar processes can be used together with the SER process of the present invention in order to produce cleaners or detergents in the form of tablet or block macrosolids.

Typically, the starting raw materials for the desired cleaner or detergent formulation are mixed or combined together at ambient temperatures to form a pre-mix, which is introduced into a reusable mold or a receiving container device. The minimum amount of solid raw material which is normally used to form a macrosolid tablet or block according to the present invention is one half gram (0.5 g).

The small amount of water required for the process of the invention is usually already present in the solid raw materials. Where this is not the case, water may be added to the raw materials prior to SE:R treatment to provide the water required, depending upon the desired formulation. Where well-characterized hydrates are used, and the other raw materials are not strongly hygroscopic, the water content may be calculated based on the chemical formula and percent of the well-characterized hydrated raw material(s) used in the pre-mix.

As will be apparent to those knowledgeable in the field, in certain instances it may be desirable to pre-heat one or more raw materials or portions thereof prior to SER treatment. Furthermore, preformed cores or plugs such as those described in U.S. Pat. Re. No. 32,763 (Fernholz, et al.) can be introduced into the container for the raw material particle bed, before or after the raw material mixture has been introduced into the mold, but before it is exposed to SER radiation. Alternatively, it may also be desirable to after-treat the macrosolid block or tablet thus formed via a subsequent technique such as dipping, spraying or coating, etc., as discussed above. Such after-treatment may be desirable where, for instance, a particular desired component of the final product is not stable to SER irradiation, or a particular characteristic enhancement or deterrent is desired.

The stability and uniformity of the subinfrared electromagnetic radiation in the SER chamber or at the point of treatment is an important factor for the successful practical application of the process according to the present invention. A non-uniform distribution of SER energy has been observed to create localized hot spots in the raw materials which can lead to uneven heating and temperature "runaway." Furthermore, a constant and non-varying SER radiation intensity from one SER treatment to the next is important, so that raw material formulations may be repeatedly and reproducibly solidified by the technique.

The amount of time required to form a macrosolid tablet or block is dependent on the sample weight, the size and shape of the container used, and either penetration depth of SER or the path length required for loss of volatilized water-. In those instances where larger amounts of water may be evolved during SER treatment, it may be desirable to sweep the treatment chamber with air or an appropriate inert gas so as to prevent condensation of undesired water within the chamber. With samples on the order of 30 g size, this was not necessary. However, even with the smaller 30 g tablets, where production conditions require large numbers of samples to be simultaneously treated, then, depending upon the size and configuration of the chamber and container in which the samples are exposed to SER, the use of a sweeping stream may be advantageous.

The present invention may be further appreciated by reference to the following specific examples and comparisons. As will be readily apparent to one skilled in the relevant art, these examples are illustrative of various parameters of the present invention, but they in no way limit its scope, except to the extent that any parameters shown in the examples may be incorporated into the appended claims.

EXAMPLES GROUP 1

General Conditions for This Group

A Microwave Laboratory Systems Büchi Model MLS 1200 T microwave generator with 2450 MHz frequency microwaves was used at a power setting of 250 watts. The compounds specified below were anhydrous (i.e., free from any stoichiometrically well characterized water of hydration) unless noted to the contrary. The compounds used were initially in granular or powdered form from conventional commercial sources. These were mixed together and then ground for about one minute in a conventional domestic: coffee grinder (Krups Type D6, 150 watts power rating) for homogenization and some size reduction. The water contents of the starting raw materials were determined by calculation from the known hydrated materials used in each example.

Thirty grams of the ground raw material mix was put into place in a standard laboratory Pyrex® glass Petri dish 5.4 cm in diameter by 2.0 cm in height. The Petri dish was gently tapped and shaken by hand to facilitate filling it with the ground raw material mix. The top of the particle bed in the Petri dish was levelled with a scraper, and a cylindrical block about 2 mm smaller in diameter than 1:he Petri dish was used to apply gentle pressure of about 0.1Newton to lightly compact the particle bed before exposure to the microwave radiation for a period of 2 to 4 minutes, except as noted. In some examples where noted below, an electronic controller linked with a temperature probe kept inside the microwave cavity in close proximity to the Petri dish containing the particle bed was used to reduce microwave power as needed to maintain the probe temperature at or below a preset level.

In each case a single macrosolid cleaner tablet with substantially the same dimensions as the container in which it had been formed and, except for Example 1.1 1, a mass of 30±3 grams was obtained. The product could be removed from the container within a few seconds after discontinuing the microwave radiation.

Example 1.1

A thirty gram (30 g) cleaner tablet was prepared according to the invention using the following procedure. Approximately 60 parts of sodium metasilicate, 24 parts of sodium tripolyphosphate (STPP), and 16 parts of sodium carbonate decahydrate were mixed together. The resulting mixture, which had an initial water content of 10%, was introduced into a container which was then placed into a microwave compartment. The mixture was e)(posed to microwave radiation for a few minutes, after which a macrosolid cleaner tablet measuring approximately 5 cm in diameter by 1.5 cm high was obtained.

Example 1.2

This sample was a variation of the formulation used in Example 1.1, in that it included an uncoated chlorine source, and hydrated forms of sodium silicate and sodium tripolyphosphate, but no sodium carbonate. The procedure used was the same as that described for Example 1.1, except that a temperature sensing probe spaced no more than 1 mm from the particle bed container was utilized, and control of the microwave generator was implemented such that the temperature was maintained below approximately 3830° K (110° C.). Accordingly, 2 parts of dichloroiso-cyanurate.$2H_2O$, 47 parts of sodium metasilicate, 10 parts of sodium silicate.$5H_2O$, 40 parts of sodium tripolyphosphate.$6H_2O$ and 1 part of paraffin oil were mixed together. The mixture, which had an initial water content of 14%, was exposed to microwave radiation for a few minutes, after which a macrosolid 30 g cleaner tablet measuring approximately 5 cm by 1.2 cm was obtained.

Example 1.3

This example illustrates the difference in having NaOH replace the sodium metasilicate of Example 1.1. In this instance, hydrous and anhydrous phosphates are also included. The procedure that was used was the same as described in Example 1.1, except that an external temperature control was implemented to prevent the temperature within the microwave chamber from exceeding 3830° K (110° C.). Accordingly, 1 part of sodium metasilicate, 14.5 parts of sodium tripolyphosphate, 14.5 parts of sodium tripolyphosphate.$6H_2O$ ("STPP"), 10 parts of sodium carbonate.$10H_2O$, and 60 parts of sodium hydroxide were mixed together to give a pre-mix that contained 10% water. This mixture was exposed to microwave radiation for a few minutes, after which a macrosolid 30 g tablet measuring approximately 5 cm by 1.2 cm was obtained. It should be noted that localized "hot spots" and temperature runaway may be observed with other similar raw materials mixes, especially those containing 65% or more of NaOH, when they are exposed to microwave radiation without any form of temperature control. Temperature control, even with samples containing as much as 50% NaOH, is therefore recommended.

Example 1.4

The purpose for this example was to provide a formulation that included sodium hydroxide with an available chlorine source. Example 1.4 therefore represents a variation on Example 1.3 above. The procedure followed was similar to that in Example 1.1. Accordingly, 57.7 parts of sodium hydroxide, 1.9 parts of coated dichloroiso-cyanurate.$2H_2O$, 1 part of sodium silicate, 14 parts of sodium tripolyphosphate, 14 parts of sodium tripolyphosphate.$6H_2O$, 9.6 parts of sodium carbonate.$10H_2O$, 0.9 parts of wax, and 0.9 parts of paraffin oil were mixed together. The mixture, which contained approximately 10% water, was exposed to microwave radiation for a few minutes, after which a macrosolid 30 g tablet measuring approximately 5 cm by 1.2 cm was obtained.

The chlorine contents of the products from Examples 2 and 4 were determined by titration, both before microwave treatment, and fourteen days thereafter. The results obtained, which gave nearly the theoretical values, are given in Table 3 below.

TABLE 3

| Available Chlorine (expressed as percent) | | |
|---|---|---|
| Example No. | Untreated Product | Fourteen Days After Treatment |
| 1.2 | 1.10 | 1.04 |
| 1.4 | 0.77 | 0.76 |

Example 1.5

This example illustrates a cleaner formulation that contained an uncoated perborate as an available oxygen source. The sample was prepared according to the procedure described in Example 1.1. Accordingly, 6 parts of uncoated sodium perborate.$H_2O$, 45 parts of sodium silicate, 15 parts of sodium silicate.$5H_2O$, 28 parts of sodium tripolyphosphate, 3 parts of sodium carbonate, and 3 parts of sodium carbonate.$10H_2O$ were mixed together, to give a pre-mix which contained approximately 9% water. Controls were implemented such that the temperature was maintained below approximately 383° K (110° C.). Afterwards, a macrosolid 30 g cleaner tablet measuring approximately 5 cm by 1.2 cm was obtained.

Example 1.6

The formulation in this example contained NaOH and a coated perborate as an available oxygen source. The sample was prepared according to the procedure described in Example 1.1. Accordingly, 50 parts of sodium hydroxide, 10 parts of sodium hydroxide.$1H_2O$, 6 parts of coated sodium perborate.$H_2O$, 1 part of sodium silicate.$5H_2O$, 23 parts of sodium tripolyphosphate, and 10 parts of sodium carbonate.$10H_2O$ were mixed together. A macrosolid 30 g cleaner tablet measuring approximately 5 cm by 1.2 cm was obtained. Controls were again implemented so that the temperature was maintained below approximately 343° K (70° C.) during microwave treatment.

Example 1.7

This was similar to Example 1.6 above, except that the raw materials contained less sodium hydroxide and more coated sodium perborate. The procedure followed was that as described in Example 1.1. Accordingly, 34 parts of sodium hydroxide, 8.5 parts of sodium hydroxide.$1H_2O$, 21.3 parts of coated sodium perborate.$H_2O$, 1.1 parts of sodium silicate.$5H_2O$, 24.5 parts of sodium phosphate, and 10.6 parts of sodium carbonate.$10H_2O$ were mixed together to give a pre-mix which contained approximately 14% water. The temperature was again maintained below approximately 343° K (70° C.) during the microwave treatment.

Example 1.8

This example was also similar to Example 1.6 above, except that the available oxygen source was coated instead of uncoated percarbonate. The procedure followed was that as described in Example 1.1. Accordingly, 50 parts of sodium hydroxide, 10 parts of sodium hydroxide.$1H_2O$, 6 parts of sodium percarbonate.$2H_2O$, 1 part of sodium silicate.$5H_2O$, 23 parts of sodium tripolyphosphate, and 10 parts of sodium carbonate.$10H_2O$ were mixed together. The mixture contained approximately 13% water. The temperature was again maintained below approximately 343° K (70° C.) during the microwave treatment.

The oxygen contents of the raw materials and products from Examples 5–8 were determined using standard titration techniques, both before and after microwave treatment. The results obtained, which gave nearly the theoretical values before treatment, are shown in Table 4 below.

As may be seen from the data in Table 4, samples containing coated oxygen sources retained at least 48% of the activity of the initial raw material after microwave treatment. The biggest difference in available oxygen content before and after microwave treatment was seen with Example 1.5, where an uncoated oxygen source was used.

Example 1.9

This example illustrates the incorporation of sodium sulfate, as well as an anionic and a non-ionic surfactant, into a cleaner formulation. The procedure

TABLE 4

| | Available Oxygen (expressed as percent) | | |
|---|---|---|---|
| Example No. | Before Microwave Treatment | After Microwave Treatment | Seven Days After Treatment |
| 1.5 | 0.9 (uncoated) | <0.1 | not avail. |
| 1.6 | 0.41 (coated) | 0.40 | 0.42 |
| 1.7 | 1.51 (coated) | 1.38 | not avail. |
| 1.8 | 0.75 (coated) | 0.36 | not avail. |

followed was similar to that as described in Example 1.1. Accordingly, 5 parts of sodium silicate, 37.5 parts of sodium carbonate, 29 parts of sodium carbonate .10$H_2O$, 25 parts of sodium sulfate, 1 part of non-ionic surfactant (TA 14) and 2.5 parts of anionic surfactant (Mersolat™ 95) were mixed together to give a pre-mix that contained approximately 18% water.

Example 1.10

This example is similar to Example 1.9 above, except that less sodium sulfate and more of the anionic surfactant was used. The procedure followed was that described in Example 1.1. Accordingly, 5 parts of sodium silicate, 37.5 parts of sodium carbonate, 29 parts of sodium carbonate.10$H_2O$, 22.5 parts of sodium sulfate, 1 part of non-ionic surfactant ($TA_{14}$™) and 5 parts of anionic surfactant (Mersolat™ 95) were mixed together to give a pre-mix that contained approximately 18% of water.

The detergent contents of the raw materials and products of Examples 9 and 10 were determined both before and after microwave treatment. The results obtained, which gave nearly the theoretical values, are shown in Table 5.

From these two examples, it may be seen that it is readily possible to incorporate anionic and non-ionic surfactants into a raw material mixture that is then exposed to microwave radiation to form a stable product that maintains an effective detergent strength. It should be noted that the surfactants may be used in virtually any form: pastes, liquids, solids, powders, flakes or granules.

TABLE 5

| | Detergent Composition (expressed as percent) | |
|---|---|---|
| Example No. | Non-ionic Detergent Before/After Microwave Treatment | Anionic Detergent Before/After Microwave Treatment |
| 1.9 | 0.99/0.96 | 1.83/1.83 |

TABLE 5-continued

| | Detergent Composition (expressed as percent) | |
|---|---|---|
| Example No. | Non-ionic Detergent Before/After Microwave Treatment | Anionic Detergent Before/After Microwave Treatment |
| 1.10 | 0.99/0.96 | 3.90/3.85 |

Example 1.11

Approximately 85.7 grams of sodium citrate.2$H_2O$, 4.3 grams of sodium sulfate.10$H_2O$, and 10 grams of Dehypon™ LT 104 (fatty alcohol polyglycol ether, terminally blocked, nonionic surfactant, product of Henkel) were mixed together and placed into the container which was introduced into a microwave compartment. The mixture was exposed to microwave radiation for 3 minutes, after which a macrosolid tablet measuring approximately 5 cm by 1.2 cm was obtained.

Example 1.12

Approximately 40.2% of sodium sulfate, 34.5% of sodium citrate dihydrate, 11.5% of SOKALAN™ CP5, 11.5% of sodium carbonate decahydrate, and 2.3% of TAED, totalling 30 g in mass, are mixed together and placed into the container as above. The mixture is exposed to microwave radiation for 3 minutes, after which a microsolid tablet measuring approximately 5 cm by 1.2 cm is obtained.

Example 1.13

Approximately 29% of sodium tripolyphosphate, 1.0% of sodium metasilicate, 8.5% of sodium carbonate decahydrate, 41% of sodium hydroxide, 15% of sodium hydroxide monohydrate, 1% of defoamer, and 4.5% of coated dichloroisocyanurate dihydrate, totalling 30 g mass, are mixed together and placed into the container as above. The mixture is exposed to microwave radiation for 3 minutes, after which a microsolid tablet measuring approximately 5 cm by 1.2 cm is obtained.

Examples 1.14–1.18

These examples were all performed in the same general manner as for the preceding examples in this group, with a total of 30 grams of raw material to produce a macrosolid tablet approximately 5 cm by 1.2 cm. The compositions of the raw materials for each of these examples are shown in Table 6.

TABLE 6

| Component of | Percent of Component in Example No.: | | | | |
|---|---|---|---|---|---|
| Raw Material | 1.14 | 1.15 | 1.16 | 1.17 | 1.18 |
| Sodium tripolyphosphate.6$H_2O$ | 0 | 0 | 19 | 19 | 0 |
| Sodium tripolyphosphate | 40 | 40 | 10 | 10 | 0 |
| Sodium metasilicate | 8 | 8 | 1 | 1 | 5.5 |
| Sodium carbonate decahydrate | 19 | 19 | 8.5 | 8.5 | 31.5 |
| Sodium carbonate | 0 | 0 | 0 | 0 | 31.5 |
| Sodium sulfate | 0 | 0 | 0 | 0 | 27.7 |
| Sodium hydroxide | 30 | 30 | 56 | 56 | 0 |
| Coated dichloroisocyanurate dihydrate | 1.0 | 2.0 | 3.5 | 0 | 0 |

TABLE 6-continued

| Component of Raw Material | Percent of Component in Example No.: 1.14 | 1.15 | 1.16 | 1.17 | 1.18 |
|---|---|---|---|---|---|
| Coated sodium perborate decahydrate | 0 | 0 | 0 | 4.5 | 0 |
| TA 14 | 0 | 0 | 0 | 0 | 1.1 |
| MERSOLAT ™ 95 | 0 | 0 | 0 | 0 | 2.7 |
| WUB ™ 308 (defoamer) | 1 | 1 | 1 | 1 | 0 |
| Paraffin oil | 1 | 0 | 1 | 0 | 0 |

Examples 1.19–1.23

These examples were all performed in the same general manner as for the other examples in this group, with a total of 30 grams of raw material to produce a macrosolid tablet approximately 5 cm by 1.2 cm, except for one important variation: The microwave radiation was pulsed, alternating for 5 sec intervals with and without radiation until a total of 45 sec of radiation time had accumulated for the samples. The compositions of the raw materials for each of these examples, all of which included a substantial proportion of the strong acid sulfamic acid, are shown in Table 7.

TABLE 7

| Component of Raw Material | Percent of Component in Example No.: 1.19 | 1.20 | 1.21 | 1.22 | 1.23 |
|---|---|---|---|---|---|
| $Na_2SO_4.10H_2O$ | 5 | 5 | 5 | 5 | 0 |
| $Na_2HPO_4.12H_2O$ | 0 | 0 | 0 | 0 | 5 |
| $Na_2SO_4$ | 0 | 0 | 5 | 0 | 0 |
| Dehyphon ™ LT 104 | 2 | 2 | 2 | 0 | 0 |
| MERSOLAT ™ H95 | 0 | 0 | 0 | 3 | 0 |
| Sulfamic acid | 95 | 93 | 88 | 92 | 95 |

Examples 1.24.–1.37

These examples were all performed in the same general manner as for the other examples in this group (except Examples 1.19–1.23), with a total of 30 grams of raw material to produce a macrosolid tablet approximately 5 cm by 1.2 cm. All of these examples utilize a preferred crystalline layered silicate material already briefly noted above, Na-SKS-6 commercially supplied by Hoechst AG. The compositions of the raw materials for each of these examples are shown in Table 8. Compositions 1.28, 1.29, 1.31, and 1.32 consist only of water (as water of hydration) and alkaline cleaning agents. They can be used, for example, as water softening compositions as part of a cleaner unit construction system ("Baukasi-ensystem")

Examples 1.38–1.43

These examples offer direct comparisons between macrosolids with crystalline layered silicates and those with anhydrous sodium metasilicate instead of the crystalline layered silicate. All these examples were performed in the same general manner as for the other examples in this group (except Examples 1.19–1.23), with a total of 30 grams of raw material to produce a macrosolid tablet approximately 5 cm by 1.2 cm. The compositions of the raw materials for each of these examples are shown in Table 9.

TABLE 8

| Component of Raw Material | Percent of Component in Example No.: 1.24 | 1.25 | 1.26 | 1.27 | 1.28 | 1.29 | 1.30 | 1.31 | 1.32 | 1.33 | 1.34 | 1.35 | 1.36 | 1.37 |
|---|---|---|---|---|---|---|---|---|---|---|---|---|---|---|
| Na-SKS-6 | 50 | 50 | 50 | 50 | 84 | 74 | 72 | 34.5 | 36.5 | 59 | 59 | 20 | 54 | 32 |
| $Na_2SiO_3.5H_2O$ | 0 | 0 | 0 | 0 | 0 | 0 | 0 | 0 | 0 | 0 | 0 | 0 | 0 | 15 |
| $Na_2CO_3$ | 0 | 0 | 0 | 0 | 0 | 0 | 0 | 32.5 | 31.5 | 0 | 0 | 44.8 | 0 | 0 |
| $Na_2CO_3.10H_2O$ | 20 | 5 | 10 | 10 | 16 | 16 | 16 | 33 | 32 | 16 | 16 | 30.2 | 16 | 8.5 |
| $Na_2SO_4$ | 0 | 0 | 0 | 5 | 0 | 0 | 0 | 0 | 0 | 0 | 0 | 0 | 0 | 0 |
| $Na_2SO_4.10H_2O$ | 0 | 0 | 10 | 0 | 0 | 0 | 0 | 0 | 0 | 0 | 0 | 0 | 0 | 0 |
| Pentasodium tripolyphosphate | 0 | 0 | 0 | 0 | 0 | 0 | 0 | 0 | 0 | 20 | 20 | 0 | 25 | 0 |
| Trisodium citrate | 0 | 0 | 0 | 0 | 0 | 10 | 0 | 0 | 0 | 0 | 0 | 0 | 0 | 0 |
| Citric acid | 0 | 0 | 0 | 0 | 0 | 0 | 12 | 0 | 0 | 0 | 0 | 0 | 0 | 0 |
| GENAPOL ™ T 110 | 30 | 45 | 0 | 0 | 0 | 0 | 0 | 0 | 0 | 0 | 0 | 0 | 0 | 0 |
| MERSOLAT ™ H95 | 0 | 0 | 30 | 35 | 0 | 0 | 0 | 0 | 0 | 0 | 0 | 0 | 0 | 0 |
| DEHYPON ™ LT 104 | 0 | 0 | 0 | 0 | 0 | 0 | 0 | 0 | 0 | 5 | 2 | 5 | 5 | 0.5 |
| Fatty alkyl sulfate surfactant | 0 | 0 | 0 | 0 | 0 | 0 | 0 | 0 | 0 | 0 | 3 | 0 | 0 | 0 |
| Coated dichloroiso-cyanurate dihydrate | 0 | 0 | 0 | 0 | 0 | 0 | 0 | 0 | 0 | 0 | 0 | 0 | 0 | 4 |

Note:
GENAPOL ™ T 110 is a surfactant made by ethoxylating a $C_{18}$ fatty alcohol with an average of 11 ethylene oxide units per molecule.

TABLE 9

| Component of Raw Material | Percent of Component in Example No.: 1.38 | 1.39 | 1.40 | 1.41 | 1.42 | 1.43 |
|---|---|---|---|---|---|---|
| Pentasodium tripolyphosphate | 40 | 40 | 39.1 | 39.1 | 0 | 0 |
| $Na_2SiO_3$ | 32 | 0 | 37.3 | 0 | 20 | 0 |
| $Na_2SiO_3.5H_2O$ | 15 | 15 | 16 | 16 | 0 | 0 |
| Na-SKS-6 | 0 | 32 | 0 | 37.3 | 0 | 20 |
| $Na_2CO_3$ | 0 | 0 | 0 | 0 | 44.8 | 44.8 |
| $Na_2CO_3.10H_2O$ | 8.5 | 8.5 | 7.6 | 7.6 | 30.2 | 30.2 |
| Coated dichloroisocyanurate dihydrate | 4 | 4 | 0 | 0 | 0 | 0 |
| DEHYPON ™ LT 104 | 0.5 | 0.5 | 0 | 0 | 5 | 5 |

Examples 1.44–1.47

These examples offer direct comparisons between macrosolids with crystalline layered silicates and those with Zeolite A, waterglass, or anhydrous sodium metasilicate instead of the crystalline layered silicate. All these examples were performed in the same general manner as for the other examples in this group (except Examples 1.19–1.23), with a total of 30 grams of raw material to produce a macrosolid tablet approximately 5 cm by 1.2 cm. The compositions of the raw materials for each of these examples are shown in Table 10.

Examples 1.48–1.52

These examples all illustrate macrosolids that are particularly useful as laundry or other textile cleaning products. They were all performed in the same general manner as for the other examples in this group (except Examples 1.19–1.23), with a total of 30 grams of raw material to produce a macrosolid tablet approximately 5 cm by 1.2 cm. Compositions of the particle bed used are shown in Table 11.

TABLE 10

| Component of Raw Material | Percent of Component in Example No.: 1.44 | 1.45 | 1.46 | 1.47 |
|---|---|---|---|---|
| $Na_2SiO_3$ | 0 | 0 | 34.5 | 0 |
| PORTIL ™ waterglass | 0 | 34.5 | 0 | 0 |
| Na-SKS-6 | 34.5 | 0 | 0 | 0 |
| $Na_2CO_3$ | 32.5 | 32.5 | 32.5 | 32.5 |
| $Na_2CO_3.10H_2O$ | 33 | 33 | 33 | 33 |
| Zeolite A | 0 | 0 | 0 | 34.5 |

Examples 1.53–1.58

These examples all illustrate macrosolids that are particularly useful as the cleaners for automatic dishwashing operations. They were all performed in the same general manner as for the other examples in this group (except Examples 1.19–1.23), with a total of 30 grams of raw material to produce a macrosolid tablet approximately 5 cm by 1.2 cm. Compositions of the particle bed used are shown in Table 12.

Examples 1.59–1.60

These examples all illustrate macrosolids that contain both acids and alkaline cleaning agents. They were all performed in the same general manner as for the other examples in this group (except Examples 1.19–1.23), with a total of 30 grams of raw material to produce a macrosolid tablet approximately 5 cm by 1.2 cm. Compositions of the particle bed used are shown in Table 13.

EXAMPLES GROUP 2

All the examples in this group were consolidated using a Hotpoint Model RE6()002.92KW microwave generator (serial number AT9789585) rated at 450 watts power output. The general conditions were otherwise the same as for Group 1, except that the containers were of high density polyethylene and the sizes of the containers were more varied, corresponding to the sizes of the particle beds used, and that the raw materials were not ground, but merely mixed together by hand, with no deliberate size reduction. The particle sizes of the

TABLE 11

| Component of Raw Material | Percent of Component in Example No.: 1.48 | 1.49 | 1.50 | 1.51 | 1.52 |
|---|---|---|---|---|---|
| $C_{12-14}$ fatty acid soap | 2 | 2 | 1.2 | 2 | 1.2 |
| $C_{12}$-alkylbenzene sulfonate | 10 | 10 | 8.9 | 13 | 9 |
| $C_{12-18}$ fatty alcohol + 5 EO[1] | 4,5 | 4.5 | 2.6 | 4 | 2.6 |
| Sokalan ™ CP5[2] | 6 | 6 | 8.2 | 5 | 8.75 |
| Hydroxyethane-1,1-diphosphonate | 0.2 | 0.2 | 0.2 | 0.2 | 0.2 |
| $Na_2CO_3.10H_2O$ | 14 | 14 | 21 | 20 | 21 |
| Amorphous sodium disilicate | 3.5 | 3.5 | 2.4 | 0.8 | 2.4 |
| Zeolite A | 35 | 0 | 32 | 6 | 0 |
| Na-SKS-6 | 0 | 35 | 0 | 43 | 32 |
| Lipase | 0.5 | 0.5 | 0 | 0.5 | 1 |
| Protease | 0.95 | 0.95 | 1 | 1 | 1 |
| Silicone oil | 0.15 | 0.15 | 0.15 | 0.15 | 0.15 |
| TAED | 5.5 | 5.5 | 5.5 | 0 | 5.5 |
| Optical brightener | 0.2 | 0.2 | 0.2 | 0.2 | 0.2 |
| Coated sodium perborate monohydrate | 16 | 16 | 12 | 0 | 12 |
| $Na_2SO_4$ | 1.5 | 1.5 | 1.65 | 4.15 | 0 |

Footnotes for Table 11
[1]This product is made by condensing an average of 5 moles of ethylene oxide ("EO") per mole of alcohol with a mixture of fatty alcohols of varying chain length as noted.
[2]This is an acrylate-maleinate copolymer available commercially from BASF.

various raw materials were as shown immediately below. The sieve sizes (numbers) noted are U.S. Standard Sieves, described in American Society for Testing and Materials ("ASTM") Standard E-11-61 as "Tyler equivalent designations".

TABLE 12

| Component of Raw Material | Percent of Component in Example No.: 1.53 | 1.54 | 1.55 | 1.56 | 1.57 | 1.58 |
|---|---|---|---|---|---|---|
| $Na_2CO_3$ | 0 | 27 | 0 | 19.5 | 0 | 0 |
| $Na_2HCO_3$ | 0 | 0 | 31 | 0 | 31.6 | 0 |
| $Na_2CO_3.10H_2O$ | 0 | 0 | 16 | 5 | 8 | 5.9 |
| Amorphous sodium disilicate | 20 | 20 | 0 | 0 | 0 | 0 |
| Na-SKS-6 | 0 | 0 | 0 | 20 | 0 | 0 |
| Trisodium citrate dihydrate | 40 | 26 | 36 | 26 | 44.9 | 0 |
| Pentasodium tripolyphosphate | 0 | 0 | 0 | 0 | 0 | 29.6 |
| Sodium metasilicate | 0 | 0 | 0 | 0 | 0 | 45.7 |
| Sodium metasilicate pentahydrate | 0 | 0 | 0 | 0 | 0 | 17.5 |
| Coated dichloroisocyanurate dihydrate | 0 | 0 | 0 | 0 | 0 | 1.3 |
| Sokalan ™ CP5 | 10 | 10 | 0 | 0 | 0 | 0 |
| Degapas ™ 3104N[1] | 0 | 0 | 0 | 12.5 | 0 | 0 |
| Coated sodium perborate monohydrate | 7 | 10 | 10 | 10 | 10 | 0 |
| Dehydol ™ LS2[2] | 1 | 1 | 1 | 1 | 1 | 0 |
| APG ™ 225[3] | 1 | 1 | 1 | 1 | 0.8 | 0 |
| TAED | 3 | 3 | 3 | 3 | 1.9 | 0 |
| Amylase | 1.5 | 1 | 1 | 1 | 1 | 0 |
| Protease | 1.5 | 1 | 1 | 1 | 0.8 | 0 |

Footnotes for Table 11
[1]This is an aqueous solution containing 40% solids of an acrylate polymer available commercially from Degussa.
[2]This as a fatty alcohol ethoxylate available commercially from Henkel KGaA.
[3]This is a $C_{8-10}$ fatty alkylpolyglucoside available commercially from Henkel Corporation.

TABLE 13

| Component of Raw Material | Percent of Component in Example No.: 1.59 | 1.60 |
|---|---|---|
| Trisodium citrate dihydrate | 55 | 57 |

TABLE 13-continued

| Component of Raw Material | Percent of Component in Example No.: 1.59 | 1.60 |
|---|---|---|
| Sulfamic acid | 30 | 10 |
| Sodium carbonate decahydrate | 5 | 13 |
| Sodium carbonate | 10 | 20 |

Sodium tetraborate tetrahydrate: 0.5%/c, maximum retained on sieve # 40; 80% minimum through sieve # 100; 10 maximum through sieve # 200.

Trisodium phosphate dodecahydrate: 99.0% minimum through sieve # 20; 10% maximum through sieve # 100.

Tetrasodium pyrophosphate (anhydrous): 5.0% maximum retained on sieve # 14; 25% maximum through sieve # 100.

Sodium tripolyphosphate hexahydrate: 1.0% maximum retained on sieve # 14; 15% maximum retained on sieve # 20; 75.0% minimum retained on sieve # 60; 10.0% maximum through sieve # 100.

Sodium tripolyphosphate granules (anhydrous): 0.5% maximum retained on sieve # 12; 12% maximum retained on sieve # 20; 5% maximum through sieve # 200.

Sodium tripolyphosphate powder (anhydrous): 5% maximum retained on sieve # 60; 90% minimum through sieve # 100.

Sodium metasilicate pentahydrate: 0.1% maximum retained on sieve # 12; 8.0% maximum retained on sieve # 20; 80% minimum retained on sieve # 50; 10% maximum through sieve # 50 but retained on sieve # 60; 5% maximum through sieve # 60 but retained on sieve # 100; 2% maximum through sieve # 100.

Sodium metasilicate (anhydrous): 2.0% maximum retained on sieve # 18; 80% minimum retained on sieve # 60; 5.0% maximum through sieve # 60 but retained on sieve # 100; 2.0% maximum through sieve # 100.

Sodium hydroxide (anhydrous): 1.0 maximum retained on sieve # 12; 40.0% maximum retained on sieve # 20; 80% minimum retained on sieve # 60; 5.0% maximum through sieve # 100.

Sodium carbonate (anhydrous): 0.5 maximum retained on sieve # 14; 10.0% maximum retained on sieve # 20; 75% minimum retained on sieve # 100; 5.0% maximum through sieve # 200.

Example 2.1

20 g of sodium metasilicate.5$H_2O$, 50 g of sodium metasilicate, and 30 g of sodium tripolyphosphate powder were mixed together to give a premix which contained approximately 8.5% water. The mixture was exposed to microwave irradiation for 2 min to give a macrosolid tablet.

Example 2.2

20 g of sodium metasilicate.5$H_2O$, 50 g of sodium metasilicate, and 30 g of sodium tripolyphosphate granules were mixed together to give a premix which contained approximately 8.5% water. The mixture was exposed to microwave irradiation for 2 min to give a macrosolid tablet.

Example 2.3

20 g of sodium metasilicate.5$H_2O$, 50 g of sodium metasilicate, and 30 g of sodium carbonate, were mixed together to give a premix which contained approximately 8.5% water. The mixture was exposed to microwave irradiation for 2 min to give a macrosolid tablet.

Example 2.4

20 g of sodium metasilicate.5 $H_2O$, 30 g of sodium metasilicate, 20 g of sodium carbonate, and 30 g of sodium tripolyphopshate granules were mixed together to give a premix which contained approximately 8.5% water. The mixture was exposed to microwave irradiation for 2 min to give a macrosolid tablet.

Example 2.5

10 g of sodium metasilicate.5 $H_2O$, 55 g of sodium metasilicate, and 35 g of sodium tripolyphosphate granules were mixed together to give a premix which contained approximately 4.3% water. The mixture was exposed to microwave irradiation for 2 min to give a macrosolid tablet.

Example 2.6

20 g of sodium tetraborate.5$H_2O$, 30 g of sodium metasilicate, 20 g of sodium carbonate, and 30 g of sodium tripolyphosphate granules were mixed together to give a premix which contained approximately 5.8% water. The mixture was exposed to microwave irradiation for 2.5 min to give a macrosolid tablet.

Example 2.7

20 g of sodium tetraborate.5$H_2O$, 50 g of sodium metasilicate, and 30 g of sodium tripolyphosphate granules were mixed together to give a premix which contained approximately 5.8% water. The mixture was exposed to microwave irradiation for 1.5 min to give a macrosolid tablet.

Example 2.8

10 g of sodium tetraborate.5$H_2O$, 40 g of sodium metasilicate, 20 g of sodium carbonate, and 30 g of sodium tripolyphosphate granules were mixed together to give a premix which contained approximately 2.9% water. The mixture was exposed to microwave irradiation for 2 min to give a macrosolid tablet.

Example 2.9

10 g of sodium tetraborate.5$H_2O$, 55 g of sodium metasilicate, and 35 g of sodium tripolyphosphate granules were mixed together to give a premix which contained approximately 2.9% water. The mixture was exposed to microwave irradiation for 100 sec to give a macrosolid tablet.

Example 2.10

10 g of trisodium phosphate.12$H_2O$, 55 g of sodium metasilicate, and 35 g of sodium tripolyphosphate granules were mixed together to give a premix which contained approximately 5.2% water. The mixture was exposed to microwave irradiation for 2 min to give a macrosolid tablet.

Example 2.11

20 g of trisodium phosphate.12$H_2O$, 30 g of sodium metasilicate, 20 g of sodium carbonate, and 30 g of sodium tripolyphosphate granules were mixed together to give a premix which contained approximately 10.4% water. The mixture was exposed to microwave irradiation for 2 min to give a macrosolid tablet.

Example 2.12

20 g of trisodium phosphate.12$H_2O$, 50 g of sodium metasilicate, and 30 g or sodium tripolyphosphate granules were mixed together to give a premix which contained approximately 10.4% water. The mixture was exposed to microwave irradiation for 2 min to give a macrosolid tablet.

Example 2.13

200 g of sodium metasilicate.5 $H_2O$, 500 g of sodium metasilicate, and 300 g of sodium tripolyphosphate granules were mixed together to give a premix which contained approximately 8.5% water. The mixture was exposed to microwave irradiation for 17 min to give a solid block containing 3.0% water.

Example 2.14

200 g of sodium metasilicate.5$H_2O$, 435 g of sodium metasilicate, 300 g of sodium tripolyphosphate granules, 50 g of sodium carbonate, 10 g of carboxymethylcellulose ("CMC") and 5 g of PVP were mixed together to give a premix which contained approximately 8.5% water. The mixture was exposed to microwave irradiation for 18 min to give a solid block containing 3.0% water. The block discolored somewhat during the microwave irradiation, presumably due to decomposition of CMC and PVP. The block was submerged in a liquid mixture of 20% of poly(ethylene glycol) with an average molecular weight of about 8000 ("PEG 8000") and 80% of nonylphenol ethoxylate having an average of 9.5 moles of ethylene oxide per mole of nonylphenol ("NPE 9.5") at 70° C. until there was no further visual evidence of evolution of gas, which was assumed to be air being displaced from the pores of the block. The block absorbed 319 g of solution, thus adding 33% to its former weight. This equals to having a block which contains 21% of NPE 9.5.

EXAMPLES GROUP 3

The following examples are consolidated using a radio wave radiation source.

Examples 3.1–3.3

General conditions are otherwise the same as for Group 1. The compositions of the raw materials for each of these examples are shown in Table 14.

EXAMPLES GROUP 4

The following examples feature compositions for a solid component comprising a macrosolid cleaner tablet, and a liquid component, which together form a two component or "dual-pack" product. The macrosolid cleaner tablets are prepared using SER under conditions which are otherwise generally the same as for Group 1. In each case, a macrosolid cleaner tablet is obtained with substantially the same dimensions as the container in which it had been formed, and has a

TABLE 14

| Component of | Percent of Component in Example No.: | | |
|---|---|---|---|
| Raw Material | 3.1 | 3.2 | 3.3 |
| Sodium metasilicate | 1 | 40.9 | 5.5 |
| Sodium metasilicate.5$H_2O$ | 0 | 11.8 | 0 |
| Coated dichloroisocyanurate dihydrate | 3.5 | 0 | 0 |
| Sodium tripolyphosphate | 30 | 38.7 | |
| Sodium hydroxide | 41 | 0 | 0 |

TABLE 14-continued

| Component of | Percent of Component in Example No.: | | |
|---|---|---|---|
| Raw Material | 3.1 | 3.2 | 3.3 |
| Sodium hydroxide.$H_2O$ | 15 | 0 | 0 |
| WUB ™ 308 (defoamer) | 1 | 1.1 | 0 |
| Sodium carbonate | 0 | 0 | 3.5 |
| Sodium carbonate decahydrate | 8.5 | 7.5 | 31.5 |
| Sodium sulfate | 0 | 0 | 27.7 |
| MERSOLAT ™ 95 | 0 | 0 | 2.7 |
| TA 14 | 0 | 0 | 1.1 |

mass of 50±5 grams. The composition for the fluid component is given as percent volume in a total of 260±26 ml.

Example 4.1

The first component of a dual-pack product according to the invention, a fifty gram (50 g) macrosolid cleaner tablet, was prepared from approximately 58 parts of sodium metasilicate, 24 parts of sodium tripolyphosphate, 16 parts of sodium carbonate decahydrate and 2 parts of Dehypon™ LT 104 (non-ionic surfactant). The second dual-pack product component, an accompanying liquid formulation totalling two hundred sixty milliliters (260 ml), was prepared from 20 parts of monoethanolamine, 14.3 parts of Propasol™ Solvent B, 14.3 parts of monophenyl glycol (technical grade) and 51.4 parts of 40% aqueous solution of sodium cumene sulfonate.

Example 4.2

The first component of a dual-pack product according to the invention, a fifty gram (50 g) macrosolid cleaner tablet similar in composition to that of Example 4.1, was prepared from approximately 56 parts of sodium metasilicate, 26 parts of sodium tripolyphosphate, 16 parts of sodium carbonate decahydrate, 1.5 parts of Dehypon™ LT 104 (non-ionic surfactant) and 0.5 parts Genapol™ OX 060 (non-ionic surfactant commercially available from Hoechst). The second dual-pack product component, an accompanying liquid formulation totalling two hundred sixty milliliters (260 ml) was prepared as for the liquid component from sample 4.2 above: 20 parts of monoethanolamine, 14.3 parts of Propasol™ Solvent B, 14.3 parts of monophenyl glycol (technical grade) and 51.4 parts of 40% sodium cumene sulfonate in water solution.

The invention claimed is:

1. A process for the formation of a unitary macrosolid from a bed of particulate matter, said process consisting essentially of:

(A) providing a container with walls penetrable by subinfrared electromagnetic radiation and having within the container a bed of particles of detergent raw material, at least part of said raw material being a hydrated material, and wherein at least one of said raw materials is a crystalline layered silicate present in an amount of at least 5%, based on the mass of said macrosolid;

(B) irradiating the bed of particles provided in step (A) for a sufficient time with subinfrared electromagnetic radiation of sufficient energy to cause the temperature of at least part of said raw material to rise and be sintered, and subsequently discontinuing the irradiation of said raw material and cooling it, so as to transform the bed of particles into a macrosolid having a length of from 5 mm to 13 mm on each edge and a porosity of from 7 to 35% of its bulk volume, said macrosolid having a bulk volume that is not greater than 1.20 times the bulk volume of the particle bed from which it was formed, said macrosolid further having a bridgework structure formed from said bed of particulate matter wherein the originally individual particles have been joined by bridges- to join the particle bed into a unitary macrosolid having pores, interstitial spaces, or both pores and interstitial spaces, and wherein upon immersion at 55° C. in a volume of water that is at least ten times the bulk volume of the macrosolid article, the macrosolid article dissolves so that no part of the macrosolid article remains in any single undissolved particle having a largest dimension greater than about 2.2 mm, within a time after immersion that is not greater than about 0.050 minutes per cubic centimeter of bulk volume of the macrosolid article.

2. A process according to claim 1, wherein said subinfrared electromagnetic radiation has frequencies in the range from about 300 to about 300,000 MHz.

3. A process according to claim 1, wherein said subinfrared electromagnetic radiation has frequencies in the range from about 3 to about 300 MHz.

4. A process according to claim 2, wherein at least about 35% of the mass of the bed of particles of raw material consists of material selected from the group consisting of alkali metal and alkaline earth metal carbonates, hydrogen carbonates, sulfates, hydrogen sulfates, silicates, phosphates, hydroxides, borates, and citrates, all of which may be hydrated or anhydrous.

5. A process according to claim 2, wherein the bed of particles contains water in an amount within the range from about 1 to about 25%.

6. A process according to claim 5, wherein the content of water in the bed of particles is within the range from about 2 to about 20%.

7. A process for the formation of a unitary macrosolid from a bed of particulate matter, said process consisting essentially of:

(A) providing a container with walls penetrable by subinfrared electromagnetic radiation and having within the container a bed of particles of detergent raw material, at least part of said raw material being a hydrated material, and wherein at least one of said raw materials is a crystalline layered silicate present in an amount of at least 5%, based on the mass of said macrosolid;

(B) irradiating the bed of particles provided in step (A) for a sufficient time with subinfrared electromagnetic radiation of sufficient energy to cause the temperature of at least part of said raw material to rise and be sintered, and subsequently discontinuing the irradiation of said raw material and cooling it, so as to transform the bed of particles into a macrosolid having a length of from 5 mm to 13 mm on each edge and a porosity of from 7 to 35% of its bulk volume, said macrosolid having a bulk volume that is not greater than 1.20 times the bulk volume of the particle bed from which it was formed, said macrosolid further having a bridgework structure formed from said bed of particulate matter wherein the originally individual particles have been joined by bridges to join the particle bed into a unitary macrosolid having pores, interstitial spaces, or both pores and interstitial spaces, and wherein upon immersion at 550° C. in a volume of water that is at least ten times the bulk volume of the macrosolid article, the macrosolid article dissolves so that no part of the macrosolid article remains in any single undissolved particle having a largest dimension greater than about 2.2 mm, within a time after immersion that is not greater than about 0.050 minutes per cubic centimeter of bulk volume of the macrosolid article, and (C) introducing additional material into the pores, interstitial spaces, or both pores and interstitial spaces of the macrosolid object formed in step (B) and causing at least part of the additional material so introduced to remain fixed within, on, or both within and on the macrosolid, so as to produce a modified macrosolid.

8. A process according to claim 7, wherein the additional material comprises at least one material selected from the group consisting of poly{alkylene glycol}s, fatty acids, fatty acid amides, paraffin waxes, sorbitol, carbohydrates, abrasives, and nonionic surfactants and the total additional material is present at the completion of the process in a sufficient amount and is so distributed as to form a coating over the material that was in the macrosolid before the introduction of the additional material.

9. A process according to claim 7, wherein said additional material comprises at least one of poly{alkylene glycol} and anionic, cationic, nonionic, and zwitterionic surfactants.

10. A process according to claim 9, wherein the final modified macrosolid product contains more than 5% of said additional material, based on the weight of said macrosolid product.

11. A process according to claim 9 wherein the final modified macrosolid product contains more than 25% of said additional material, based on the weight of said macrosolid product.

12. A process according to claim 7, wherein the additional material comprises an enzyme.

13. A process according to claim 2, wherein the macrosolid product has a water content within the range from about 0.1 to about 11%.

14. A process according to claim 13, wherein the water content is within the range from about 0.5 to about 10%.

15. A process according to claim 14, wherein the water content is within the range from about 2 to about 6%.

16. A process according to claim 1, wherein at least half of the mass of the raw material consists of chemical species that are solid at 25° C. and are soluble or homogeneously dispersible in water at 25° C. to form solutions containing at least 10 grams per liter of the dissolved or homogeneously dispersed solid chemical species; the ratio of the smallest dimension of the macrosolid made by the process to the smallest dimension of the particles in the bed of particles is at least about 10:1; and at least about 60% of the volume of the bed of particles is solid at the temperature of the bed of particles before beginning irradiation with subinfrared electromagnetic radiation.

17. A process according to claim 16, wherein said subinfrared electromagnetic radiation has frequencies in the range from about 300 to about 300,000 MHz.

18. A process according to claim 16, wherein said subinfrared electromagnetic radiation has frequencies in the range from about 3 to about 300 MHz.

19. A process according to claim 2, wherein at least about 50% of the mass of the bed of particles of raw material consists of material selected from the group consisting of sodium, potassium, and magnesium sulfates, hydrogen sulfates, carbonates, hydrogen carbonates, silicates, phosphates, hydroxides, borates, and citrates; at least about 70% of the volume of the bed of particles is solid at the temperature of the bed of particles before beginning irradiation with subinfrared electromagnetic radiation; and the pore volume of each of the bed of particles and the macrosolid is within the range from about 3 to about 45% of the respective bulk volumes.

20. A process according to claim 2, wherein the macrosolid product produced by the process has the property that upon immersion at 55° C. in a volume of water that is at least ten times the bulk volume of the macrosolid, the macrosolid dissolves, disintegrates, or both dissolves and disintegrates, so that no part of the macrosolid remains in any single undissolved particle having a largest dimension greater than about 2.2 mm, within a time after immersion that is not greater than about 0.036 minutes per cubic centimeter of bulk volume of the macrosolid.

21. A process according to claim 2, wherein the bed of particles contains at least one material selected from the group consisting of coated chlorine sources, uncoated chlorine sources, coated chlorine-containing materials, uncoated chlorine-containing materials, coated active oxygen sources, and uncoated active oxygen sources.

* * * * *